US007128592B2

(12) United States Patent
Li

(10) Patent No.: US 7,128,592 B2
(45) Date of Patent: Oct. 31, 2006

(54) INTERCONNECTION DEVICE AND SYSTEM

(75) Inventor: Che-Yu Li, Roslyn, NY (US)

(73) Assignee: Che Yu Li & Company, LLC, Ithaca, NY (US)

( * ) Notice: Subject to any disclaimer, the term of this patent is extended or adjusted under 35 U.S.C. 154(b) by 0 days.

(21) Appl. No.: 11/082,365

(22) Filed: Mar. 17, 2005

(65) Prior Publication Data

US 2006/0009055 A1 Jan. 12, 2006

Related U.S. Application Data

(60) Provisional application No. 60/586,777, filed on Jul. 9, 2004.

(51) Int. Cl.
*H01R 13/28* (2006.01)

(52) U.S. Cl. ..... 439/289

(58) Field of Classification Search ..... 439/289, 439/188, 271, 591, 66, 67
See application file for complete search history.

(56) References Cited

U.S. PATENT DOCUMENTS 2,619,515 A * 11/1952 Doane ..... 439/274
4,220,385 A * 9/1980 Luca et al. ..... 439/589
4,529,257 A * 7/1985 Goodman et al. ..... 439/271
5,248,259 A * 9/1993 Naito et al. ..... 439/34
5,980,288 A * 11/1999 Jarvis ..... 439/188
6,064,217 A * 5/2000 Smith ..... 324/760
6,312,266 B1 * 11/2001 Fan et al. ..... 439/91

* cited by examiner

*Primary Examiner*—Phuong Dinh
(74) *Attorney, Agent, or Firm*—Duane Morris LLP

(57) ABSTRACT

A connector system including first housing having a first header, the first header including one or more conductive pads that are in electrical communication with a conductor. A second housing that is mateable with the first housing and includes a second header positioned on a mating face. The second header includes one or more conductive pad that are electrically engaged with a conductor and positioned in confronting relation with the one or more conductive pads of the first header. An interposer located between the first header and the second header, with an electrical contact that extends continuously through the interposer toward conductive pads on the first and second headers. The interposer is movable between a first position where the electrical contact is spaced away from the at least one of the conductive pads, and a second position where the electrical contact electrically engages one of the conductive pads.

17 Claims, 18 Drawing Sheets

INTERCONNECTION DEVICE AND SYSTEM

This application claims the benefit of U.S. Provisional Patent Application No. 60/586,777, filed on Jul. 9, 2004.

FIELD OF THE INVENTION

The present invention generally relates to the electrical interconnection devices, and more particularly to electrical connectors that are at the interface between a first electronic device and a substrate, mating electrical connector, or a circuit board within an electronic system.

BACKGROUND OF THE INVENTION

Electrical connectors are used in many electronic systems. As miniaturization of the electronic systems becomes more prevalent, the dimensions of the connector itself decrease but the number of signal circuits routed through the connector increases. This results in an increasing number of signals in the limited space of the connector. As the signal circuits are spaced closer and the transmission speed of the signals increases, electromagnetic interference (EMI) and crosstalk become a serious problem. It is desirable that the components of an interconnection path be optimized for signal transmission characteristics; otherwise, the integrity of the system will be impaired or degraded. Such characteristics include low inductance, increased current carrying capacity, suitable roll-off, and reduced ground bounce. Continuous efforts have been made to develop electrical connectors that have as little effect as possible on electronic system performance and integrity.

Inductance is one concern in designing a connector, particularly when that connector is to be used in a signal transmission portion of a high speed electronic system. An example of one such connector is a so called "board-to-board" connector. A board-to-board connector provides the electrical, and often mechanical interface between printed circuit boards (PCB's) in an electronic system. Such connectors often have an elongated housing defining an elongated array of receptacles or slots for receiving a mating edge of the printed circuit board, or a field of pins projecting from the surface of the PCB that are mated to a corresponding field of contact receptacles. In many applications, such connectors are mounted on two or more PCB's commonly referred to as "daughter boards", which are mounted to a "mother board."

An inductive effect results from the interconnection of the PCB's which acts to change the characteristic impedance of the circuit and thereby negatively affect the signal transmission capacity of the system. Accordingly, it is desirable to reduce the inductive effects due to the interconnection of the PCB's, and thereby fulfill a need for an interconnection system that reduces inductive effects between the boards being connected. It would also be desirable to increase the current carrying capacity between the PCB's. Examples of such prior art board-to-board connectors may be found in U.S. Pat. Nos. 6,790,048; 6,776,668; 6,733,305; 6,729,890; 6,609,914; 6,599,138; 6,464,515; 6,338,630; 6,312,263; 6,183,315; 6,089,883; 6,220,903; 6,059,610; 6,036,504; 5,921,787; 5,876,219; and 5,873,742, which patents are hereby incorporated herein by reference.

Electrical connectors are often used in environments where they are exposed to dust and dirt, and may even be used in environments where they are subject to splash or immersion in water. It is desirable to seal the connector assembly to protect the terminals from exposure to the external environment. Very often the connector bodies are each formed with a plurality of passages that extend into the connector bodies from a cable end, and into which the cables and their terminals are received. In a sealed connector application, a seal is provided about the cable such that, when installed in the corresponding passage, it serves to seal the passage from the outside environment. The connectors are also sometimes filled with a potting material which will cover the rear entry of the electrical connector so as to protect it from the ingress of contaminants. It is necessary to prevent the entry of contaminants into the interior of the electrical connector, since these contaminants corrode the electrical contact surfaces which often leads to intermittent or unreliable electrical connections. Many types of seals and sealed connector systems are known for keeping contaminants from entering an electrical connector housing. Examples of such prior art sealed connector systems may be found in U.S. Pat. Nos. 6,821,145; 6,767,250; 6,547,584; 6,383,003; 6,132,251; 6,109,945; 6,050,839; 5,823,824; 5,785,544; 5,775,944; 5,595,504; 5,356,304; 4,983,344; 4,961,713; 4,944,688; 4,934,959; 4,895,529; 4,832,615; 4,776,813; 4,772,231; 4,085,993; 4,150,866; and 4,639,061, which patents are hereby incorporated herein by reference.

All of the foregoing connector systems rely upon one or more resilient conductive contacts having a variety of shapes, sizes, and spring characteristics. A commonly used form of resilient conductive contact includes an interconnection end for matting with a corresponding end of a mating contact or PCB, and a termination end for terminating a circuit trace or wire. These ends are often connected by a resilient portion of the contact which provides for the storage of elastic energy. Prior art resilient conductive contacts may be a single metal structure in the form of a spring to provide the required elastic response during service while also serving as a conductive element for electrical connection. Typically, a combination of barrier metal and noble metal platings are applied to the surface of the spring for corrosion prevention and for electrical contact enhancement. It is often the case that these platings are not of sufficient thickness for electrical conduction along only the surface of the spring. Examples of such prior art resilient conductive contacts may be found in U.S. Pat. Nos. 5,653,598; 5,173,055; 5,059,143; 4,906,194; 4,927,369; 4,699,593; and 4,354,729, which patents are hereby incorporated herein by reference.

One problem in the art exists in that a good material for the construction of a spring, such as a high strength steel, is not a very good electrical conductor. On the other hand, a good electrical conductor, such as a copper alloy or precious metal, often does not provide adequate spring properties. There has been a need in the connector arts for a more resilient conductive contact which incorporates the seemingly opposing requirements of good spring properties, temperature resistance, and high conductivity. Therefore, an improved electrical contact for use in an electrical connector is needed which can overcome the drawbacks of conventional electrical contacts. It is desirable that a good electrical contact element possess the following attributes: (a) usable in a wide variety of inter-connection structures; (b) a large elastic compliance range and low contact forces; (c) capable of transmitting high frequency signals and high currents; (d) capable of withstanding high operating temperatures; and (e) exhibiting high durability, i.e. >500K repeated deflections.

The prior art has been devoid of at least one of the foregoing attributes necessary for a universally applicable electrical connector.

SUMMARY OF THE INVENTION

The present invention provides a connector system that often includes a first housing having a first header positioned on a mating face. The first header includes at least one conductive pad that is electrically engaged with a conductor such as a wire. A second housing is provided that is mateable with the first housing, and includes a second header positioned on a mating face. The second header includes at least one conductive pad that is electrically engaged with a conductor, such as a wire, and is positioned in confronting relation with the at least one conductive pad of the first header. A contact interposer is located between the first header and the second header. The contact interposer includes at least one contact that extends continuously through the contact interposer so as to have a portion projecting outwardly toward the at least one conductive pad of the first header and another portion projecting outwardly toward the at least one conductive pad of the second header. The contact interposer is movable between (i) a first position in which the portions of the at least one contact are spaced away from the conductive pads, and (ii) a second position in which the portions of the at least one contact electrically engage both of the conductive pads.

BRIEF DESCRIPTION OF THE DRAWINGS

These and other features and advantages of the present invention will be more fully disclosed in, or rendered obvious by, the following detailed description of the preferred embodiments of the invention, which are to be considered together with the accompanying drawings wherein like numbers refer to like parts and further wherein.

DETAILED DESCRIPTION OF THE PREFERRED EMBODIMENT

Figure 1:
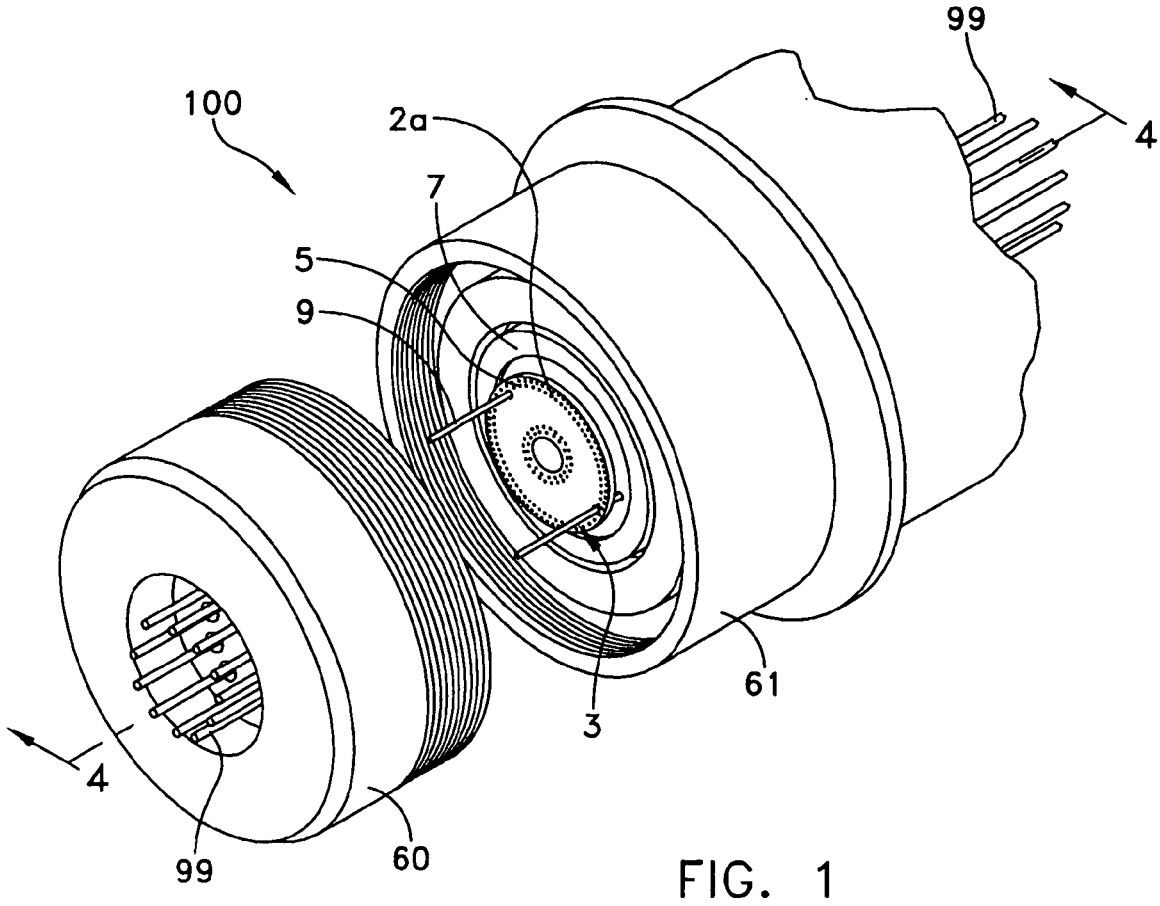
FIG. 1 is a perspective view of a wire-to-wire connector assembly formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses, if used, are intended to cover the structures described, suggested, or rendered obvious by the written description or drawings for performing the recited function, including not only structural equivalents but also equivalent structures.

Figure 20:
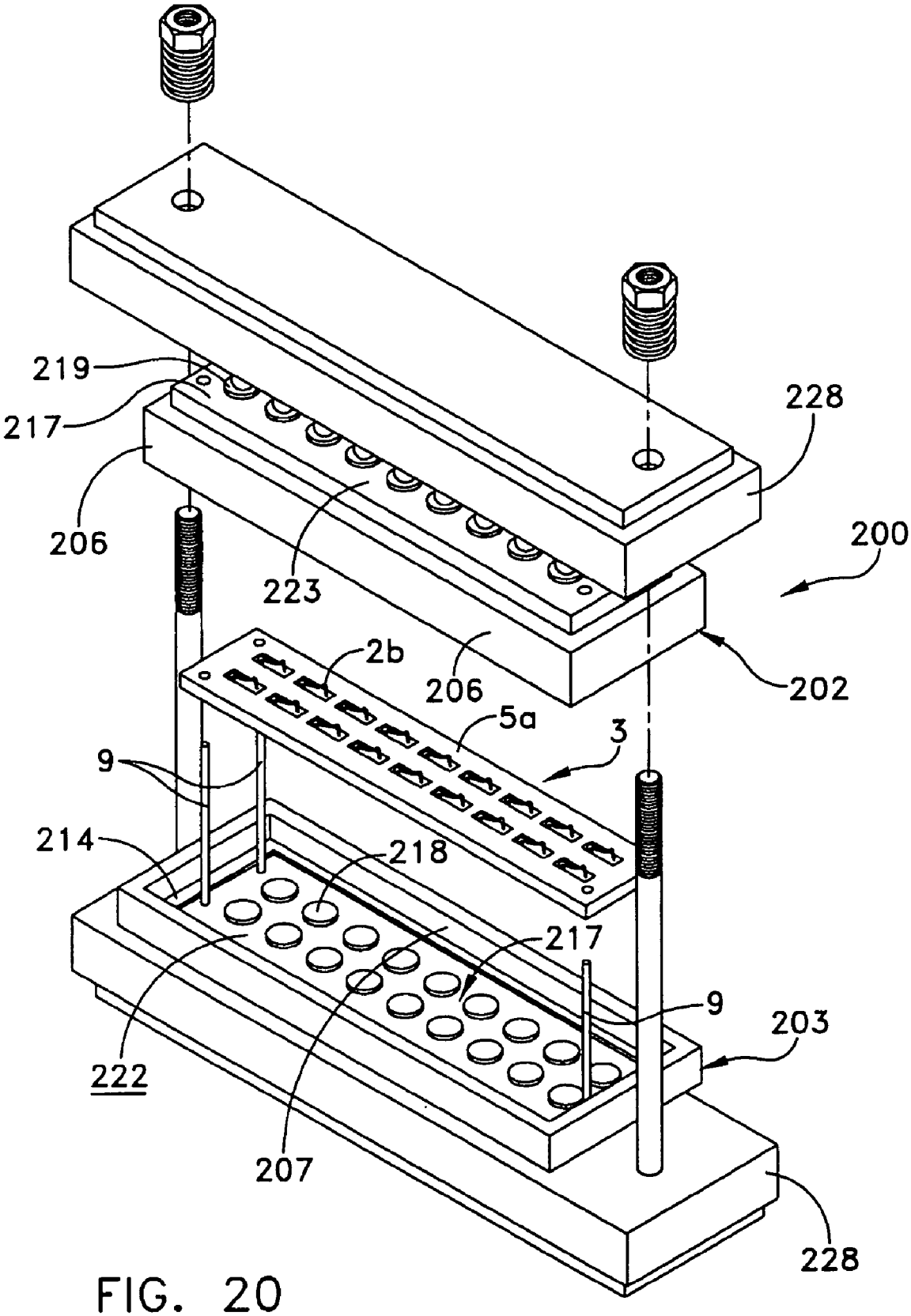
FIG. 20 is a perspective, exploded view of an alternative embodiment of the present invention arranged in a board-to-board connector system.
Figure 26:
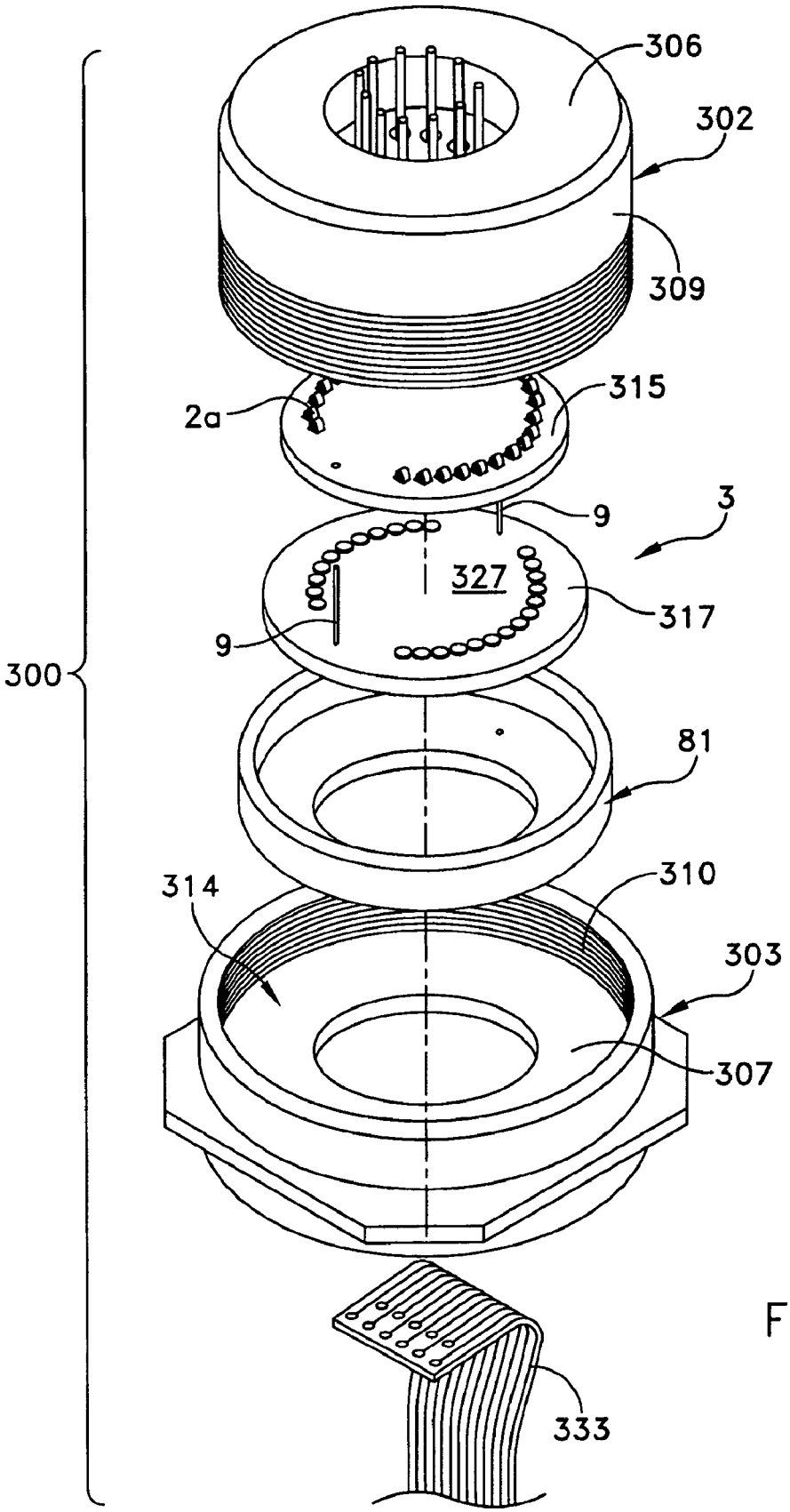
FIG. 26 is an exploded perspective view of a wire-to-ribbon cable connector system formed in accordance with the present invention.

Referring to FIGS. 1, 20 and 26 a wide variety of electrical interconnection systems and connectors may be formed in accordance with the present invention, such as a wire-to-wire connector system 100, a board-to-board connector system 200, or a wire-to-ribbon connector system 300. In these and other connector systems one or more electrical contacts are arranged in an interposer assembly 3 including a contact interposer 5, one or more terminal headers 7, and one or more pilots 9. Interposer assembly 3 provides for proper alignment and orientation of the electrical contacts within the particular connector system where, owing to the resilient structure of the electrical contact, the connector system provides enhanced operating characteristics as compared to prior art electrical interconnection systems.

Figure 3:
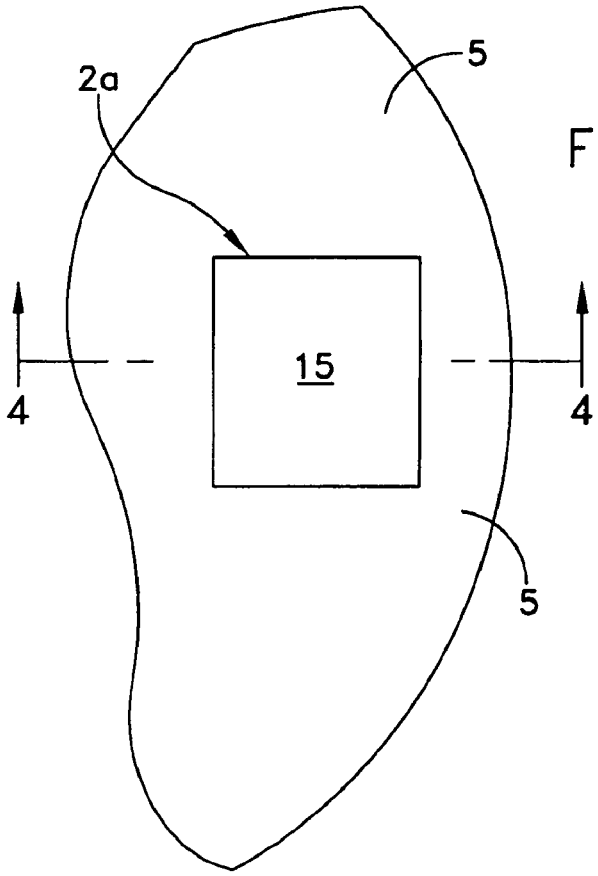
FIG. 3 is a of top plan view of the electrical contact and contact interposer shown in FIG. 2.
Figure 4:
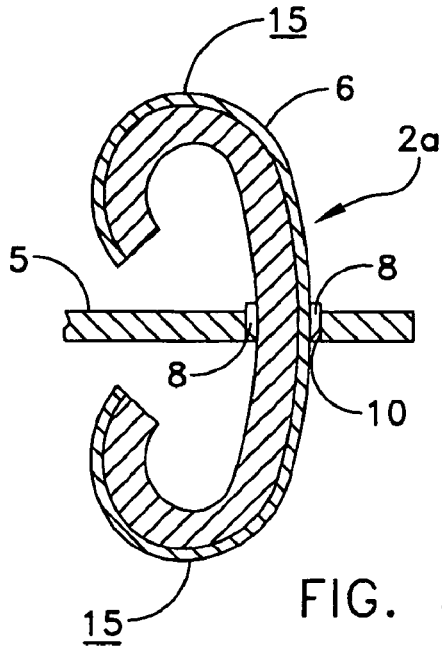
FIG. 4 is a cross-sectional view of an electrical contact as taken along the lines 4—4 in FIG. 3.
Figure 2:
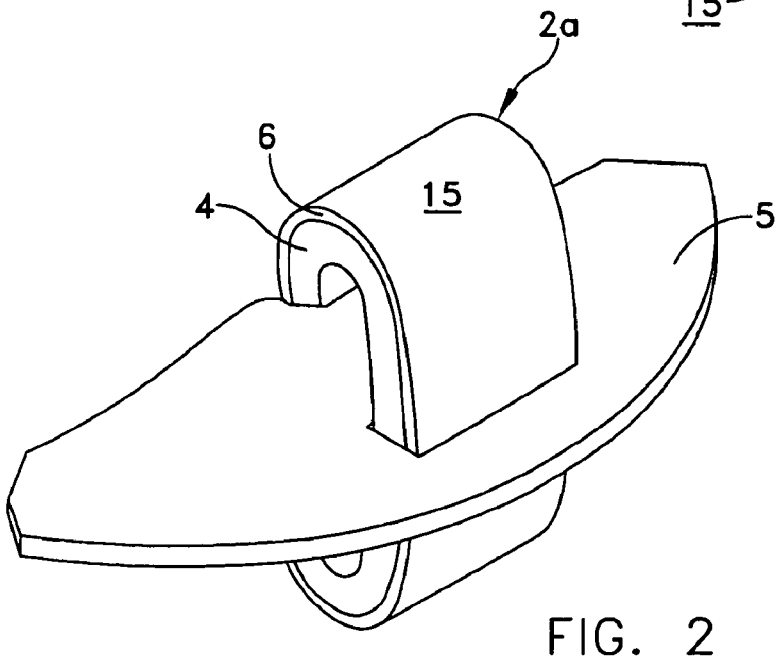
FIG. 2 is a perspective view of an electrical contact and contact interposer suitable for use with the present invention.

Electrical contacts suitable for use in the present invention may comprise a wide variety of shapes and spring-types, as long as they exhibit a large elastic range and low characteristic impedance. For example, in one embodiment a plurality of c-shaped electrical contacts 2*a* may be used in connection with the present invention that are made from a sheet of INCONEL X, a corrosion resistant alloy of nickel chromium that is commercially available from Huntington alloys, a division of Inco Alloys International of Huntington, W.Va. 25720. INCONEL X is a trademark of Inco Alloys International. Referring to FIGS. 2–4, electrical contacts 2*a* each comprise a resilient portion 4, a cladding layer 6, and a pair of engagement surfaces 15. Cladding layer 6 may comprise any of the well known materials that are suitable for electrical engagement surfaces, e.g., gold, tin, etc. Electrical contacts 2*a* are often slit from a larger sheet resulting in flat rectangular blanks (not shown). The blanks are then subjected to a forming process, which is well known in the art, which upsets the metal and forms a small lateral rib or projection 8 at the center of the blank along both sides as shown in FIG. 4.

In another embodiment, electrical contact 2*b* is preferably stamped from sheet metal to form a generally planar contact body having first and second major faces 17, 18 corresponding to surfaces of the metal from which it is stamped, often with a thickness T of approximately 0.0045 inches or less. Electrical contact 2*b* includes a pair of spring arms 20, 21 which are connected at one end by a resilient bight portion 23. Bight portion 23 is preferably an arcuate section which enhances flexibility in the plane of the contact, although bight portion 23 may be defined more sharply by an intersection of arms 20, 21 at an acute angle. Often, bight portion 23 is bisected by central axis A of the contact. Arms 20, 21 are spaced apart at some dimension when the contact is in an undeflected state. Preferably, arms 20, 21 angularly diverge as they extend from bight portion 23, although the arms may be parallel to each other. Arms 20,21 also extend slightly out of the plane of electrical contact body 2*b* as they extend away from bight portion 23. Arms 20,21 have respective free ends with outwardly facing edges defining a pair of oppositely facing contact noses 25, 26 each engagable with a contact pad disposed on termination header 7, as will hereinafter be disclosed in further detail. Respective shorting sections 29, 30 extend from each of the free ends generally toward each other. Shorting sections 29, 30 are offset slightly from each other due to the arms extending slightly out of the plane of electrical contact 2*b*. An extremely short electrical path, e.g., as is formed between shorting sections 29, 30, is desirable for high speed (high frequency) devices in order to avoid inductance effects.

Electrical contacts 2*a* and 2*b* are often made of a spring temper alloy in which a substantial portion includes precious metals, such as palladium, gold, or silver, as well as nickel and other non-precious metals. Significantly, in addition to spring characteristics, the ability of the contact to mate with a solder lead without transfer of solder metal from the solder lead to the contact is vital. Of the non-noble metals, beryllium-nickel alloy appears to meet that requirement, as do the above-listed precious metals. Since these materials are quite expensive, efficient material utilization is an important factor in deciding on the shape of the electrical contacts 2*a* and 2*b*.

Referring to FIGS. 1 and 17–19, electrical contacts such as the foregoing exemplary contacts 2*a* or 2*b* may be associated with a wide variety of electrical interconnection systems formed in accordance with the present invention with good effect. For example, electrical contacts 2*a* or 2*b* may be positioned and supported within a wire-to-wire interconnection device 100 that includes a pair of substantially circular mateable dielectric housings 60 and 61 that are each molded from a suitable polymer material. Polymeric materials useful in this invention include any material useful in the electronics industry, including, without limitation, thermoplastics (crystalline or non-crystalline, cross-linked or non-cross-linked), thermosetting resins or blends or composites thereof. Illustrative examples of useful thermoplastic polymers include, without limitation, polyolefins, such as polyethylene or polypropylene, copolymers (including terpolymers, etc.) of olefins such as ethylene and propylene, with each other and with other monomers such as vinyl esters, acids or esters of unsaturated organic acids or mixtures thereof, halogenated vinyl or vinylidene polymers such as polyvinyl chloride, polyvinylidene chloride, polyvinyl fluoride, polyvinylidene fluoride and copolymers of these monomers with each other or with other unsaturated monomers, polyesters, such as poly(hexamethylene adipate or sebacate), poly(ethylene terephthalate) and poly(tetramethylene terephthalate), polyamides such as Nylon-6, Nylon-6, 6, Nylon-6,10, Versamids, polystyrene, polyacrylonitrile, thermoplastic silicone resins, thermoplastic polyethers, thermoplastic modified cellulose, polysulphones and the like. Examples of some thermosetting resins useful herein include, without limitation, epoxy resins, such as resins made from epichlorohydrin and bisphenol A or epichlorohydrin and aliphatic polyols, such as glycerol, and which can be conventionally cured using amine or amide curing agents. Other examples include phenolic resins obtained by condensing a phenol with an aldehyde, e.g., phenol-formaldehyde resin.

Figure 17:
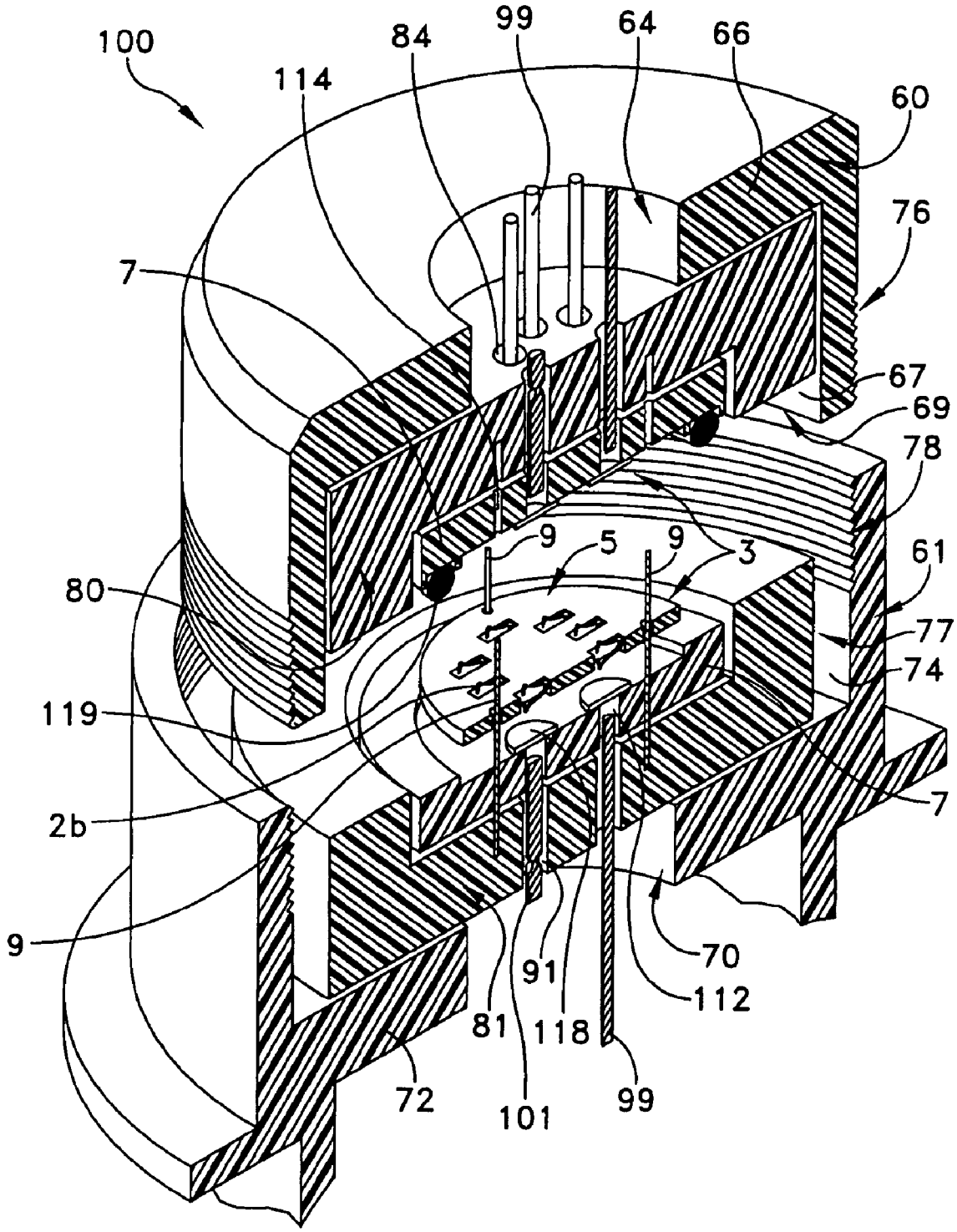
FIG. 17 is a cross-sectional perspective and exploded view of a wire-to-wire connector formed in accordance with the present invention.

Housing 60 often includes a conductor or wire-receiving passageway 64 extending through a base wall 66 and surrounded by an annular wall 67 that together define an interior recess 69 into which wire-receiving passageway 64 opens (FIG. 17). Housing 61 often includes a wire-receiving passageway 70 extending through a base wall 72 and surrounded by an annular wall 74 that together define an interior recess 77 into which wire-receiving passageway 70 opens. In the illustrated embodiment, annular wall 67 has an outer diameter that is slightly smaller than the inner diameter of annular wall 74, and includes threads 76 along a portion of its length so that housing 60 may be received in corresponding threads 78 on an inner surface of annular wall 74 of housing 61 (FIGS. 1 and 17–19). Thus when housing 60 is mated with housing 61 and rotated, the pair of housings 60,61 move toward one another so as to close the distance between the confronting inner surfaces of base walls 66 and 72 (FIG. 19). It will be understood that such wire-to-wire connector systems may include a wide variety of alternative structures for securely inserting housing 60 into housing 61, e.g., latches, bayonet mounts, interference fits, etc.

A pair of guide-cradles 80,81 are often located within housings 60,61 on the interior surface of base walls 66,72, respectively. Guide-cradle 80 often includes a wire-receiving passageway 84 extending through a mating face and surrounded by an annular wall that together define an interior recess into which wire-receiving passageway 84 opens. Guide-cradle 81 includes a wire-receiving passageway 91 extending through a mating face and surrounded by an annular wall that together define an interior recess into which wire-receiving passageway 91 opens. Guide-cradles 80, 81 provide support and organization for wires 99 entering housings 60,61. It will be understood that a wire-crimp contact terminal 101 may also be received within passageways 84,91 so as to form an electrical or signal transmission pathway.

Figure 5:
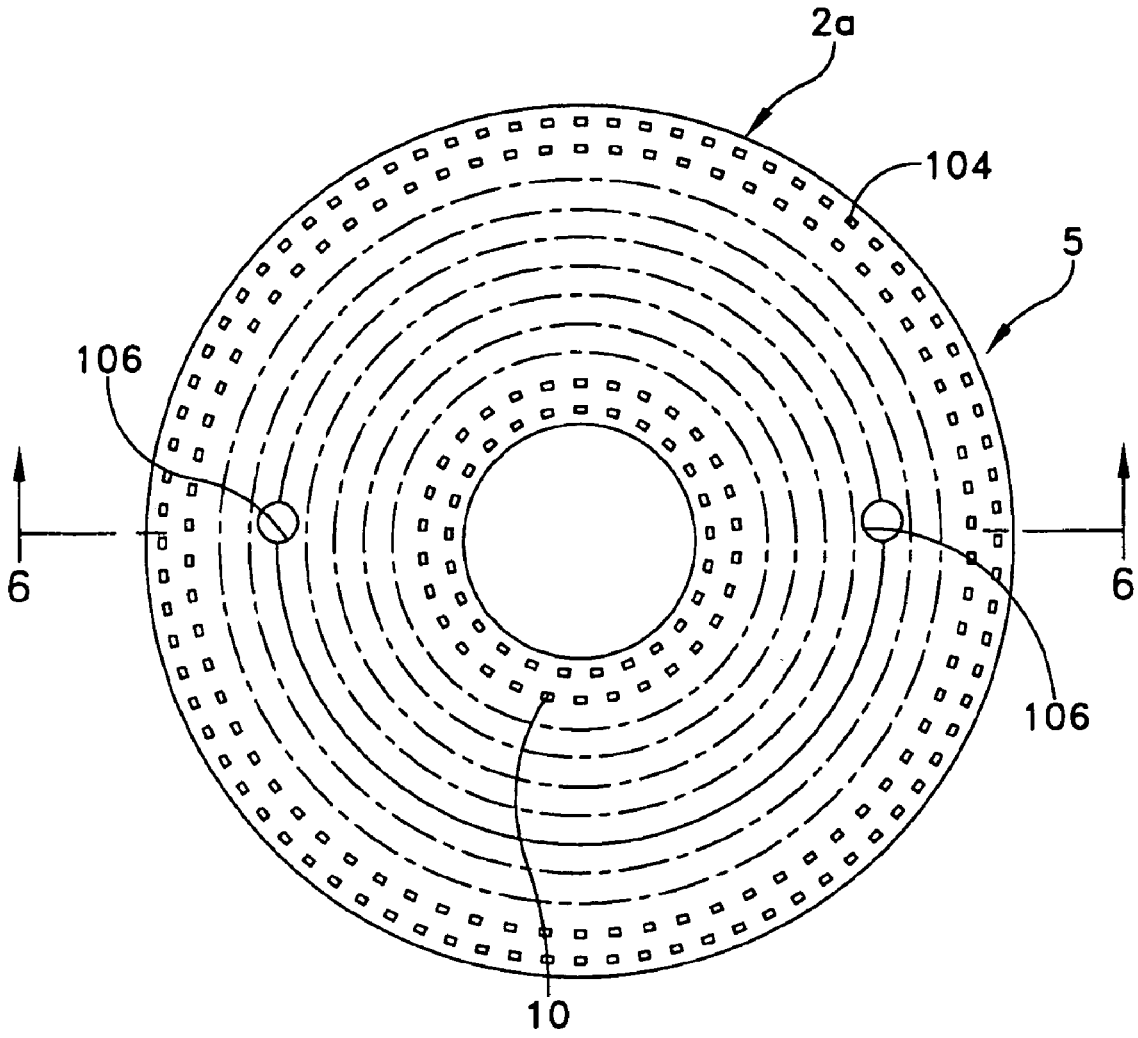
FIG. 5 is a plan view of one embodiment of an contact interposer formed in accordance with the present invention.
Figure 6:
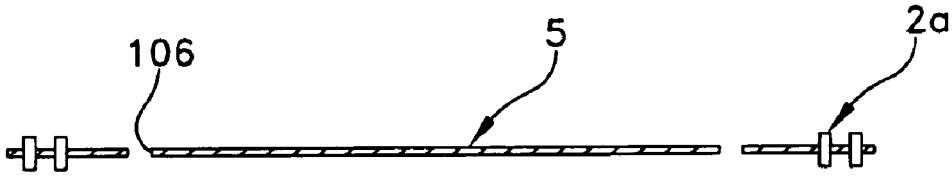
FIG. 6 is a cross-sectional view of the contact interposer in FIG. 5, as taken along the lines 6—6 in FIG. 5.
Figure 7:
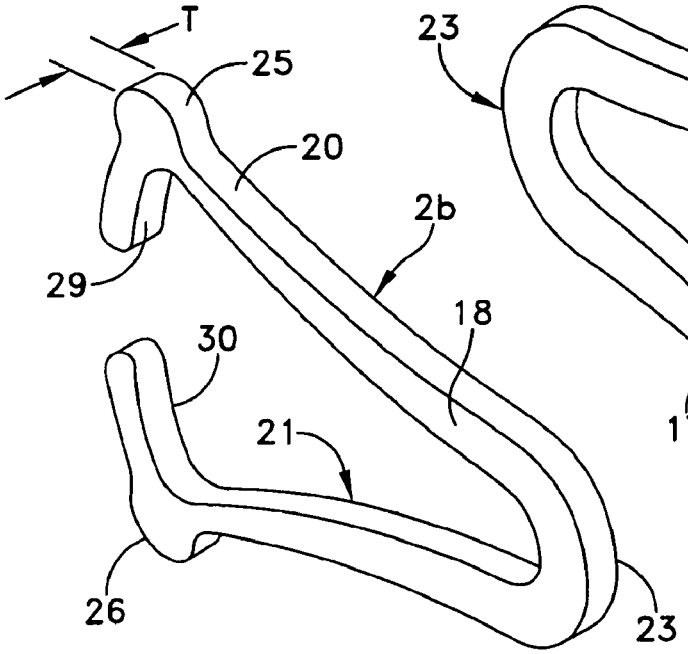
FIGS. 7 and 8 are perspective views of an alternative embodiment of electrical contact formed in accordance with the invention, from opposite view points.
Figure 8:
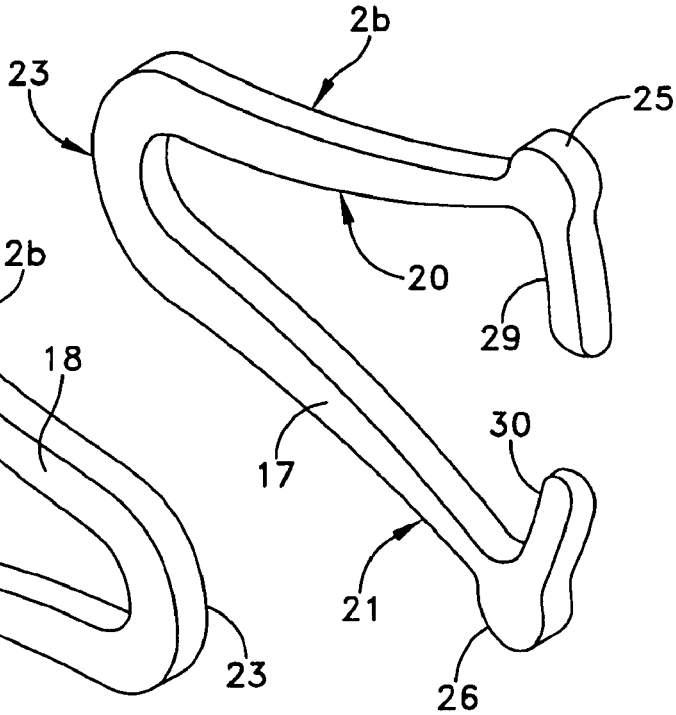
Figure 9:
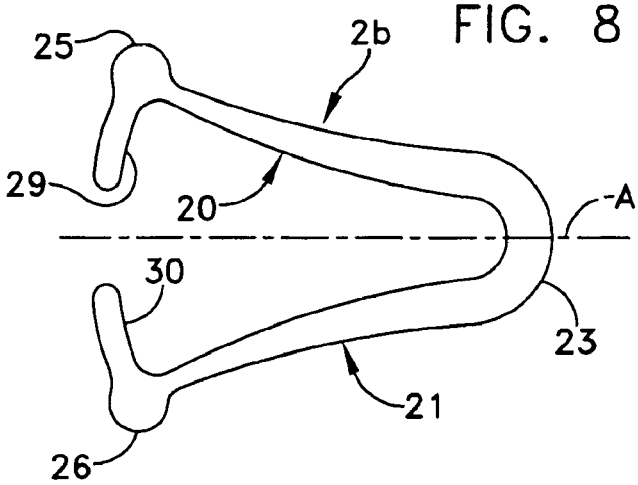
FIG. 9 is a side view of the electrical contact shown in FIGS. 7 and 8.
Figure 10:
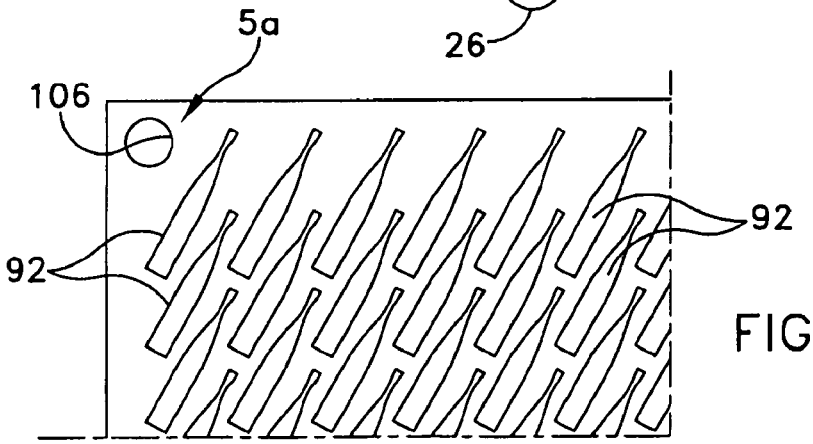
FIG. 10 is a top view of a portion of a contact interposer having cavities which can receive the electrical contact shown in FIGS. 7–9.

Interposer assembly 3 includes a contact interposer 5 or 5*a*, a pair of termination headers 7, and one or more pilot pins 9. Interposer assembly 3 is positioned between housings 60,61 with some portions located within housing 60 and other portions located on housing 61 (FIGS. 17 and 19). Contact interposers 5 or 5*a* are often formed from a standard epoxy and fiber glass printed wiring board (PCB) having a plurality of through-bores defined through their thicknesses and arranged in a regular pattern or array of predetermined shape and center-line spacing (FIGS. 5, 6, and 10). Of course, contact interposers 5 or 5*a* may comprise other materials, e.g., ceramics, polymers, and/or composite materials. One or more pilot holes 106 are defined through contact interposers 5 or 5*a*.

In one embodiment that is associated with electrical contact 2*a*, preformed flat rectangular blanks (not shown) are inserted into openings 104 that have been formed in contact interposer 5 so that ribs 8 are forced into wedging engagement with the sides of contact interposer 5 that define an opening 10 (FIGS. 2 and 4–6). This arrangement holds all of the blanks captive in contact interposer 5 until they are formed into the final c-shape. This forming is done with a pair of forming dies in the usual manner which is typically a two step process. In a first step the outer portions of each end of the blanks are slightly bent in the desired direction of the C-shaped curve. In a second step a final forming to the desired shape is accomplished with a forming die designed for the purpose. Such forming dies are well known in the metal forming art and therefore are not described here.

Figure 11:
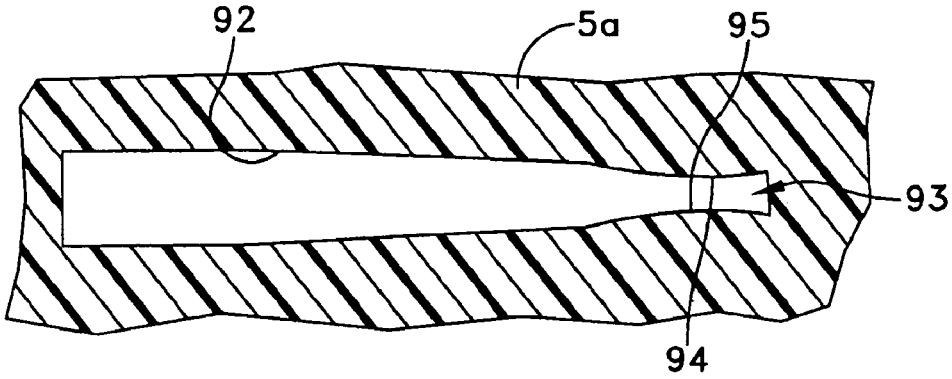
FIG. 11 is an enlarged view of an empty cavity in the contact interposer of FIG. 10.
Figure 12:
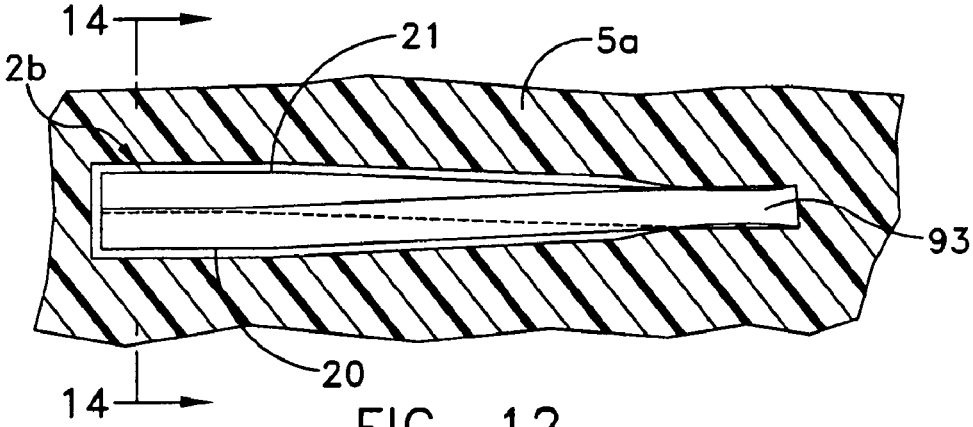
FIG. 12 is an enlarged view of a cavity in the contact interposer of FIG. 10, with an electrical contact installed according to the invention.
Figure 13:
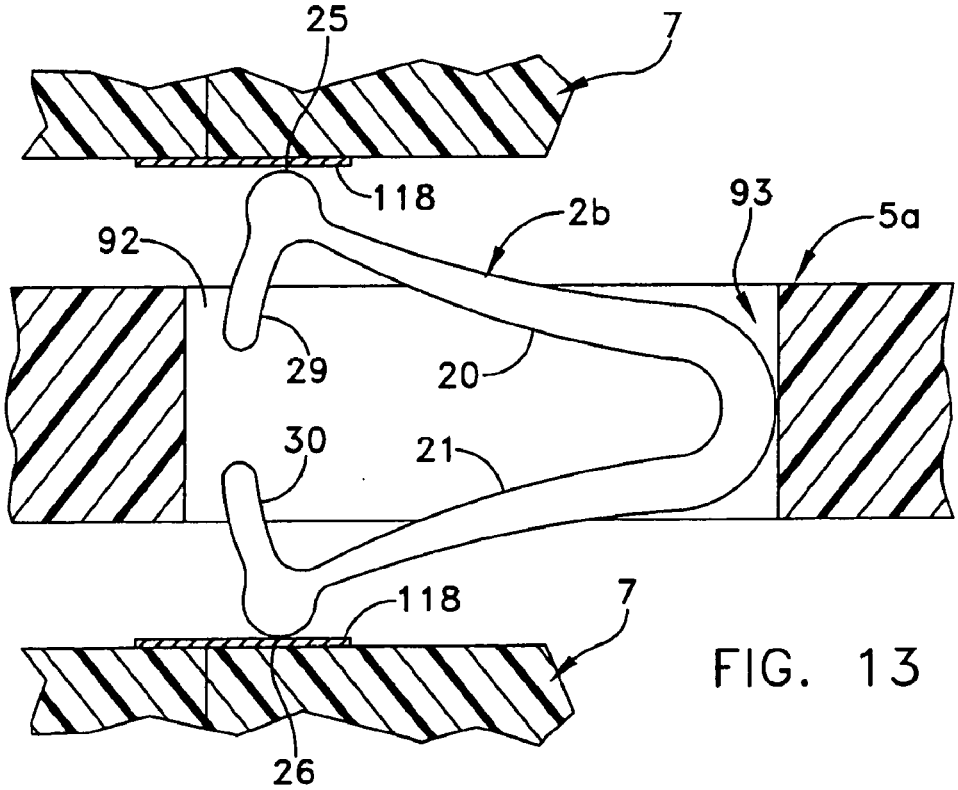
FIG. 13 is a cross-sectional, exploded view of the electrical contact shown in FIGS. 7–9 in undeflected condition, positioned within a contact interposer, and about to be compressed between a pair of opposing termination headers according to the invention.
Figure 14:
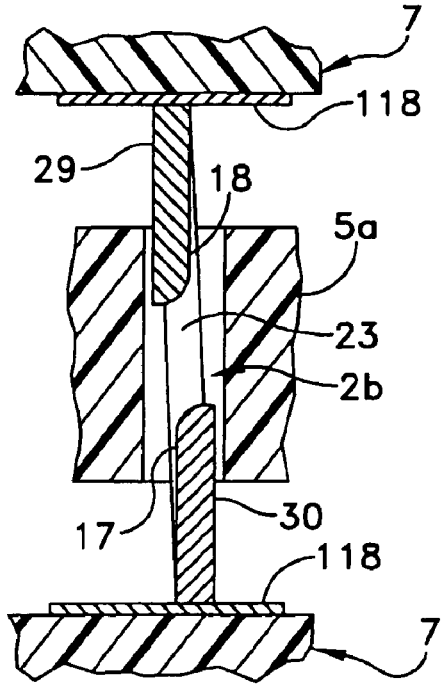
FIG. 14 is a cross-sectional view taken along line 14—14 of FIG. 16.

In another embodiment that is associated with electrical contact 2*b*, contact interposer 5*a* includes a plurality of contact cavities 92 arranged in a predetermined pattern or array through its thickness (FIGS. 10–12). Each of contact cavities 92 comprises an elongated slot which extends through contact interposer 5*a* from top to bottom, and includes a contact retention section 93 defined by opposed surfaces 94, 95 which are spaced apart at a dimension selected to produce a slight interference fit with electrical contact 2*b* near bight portion 23 (FIG. 12).

Figure 18:
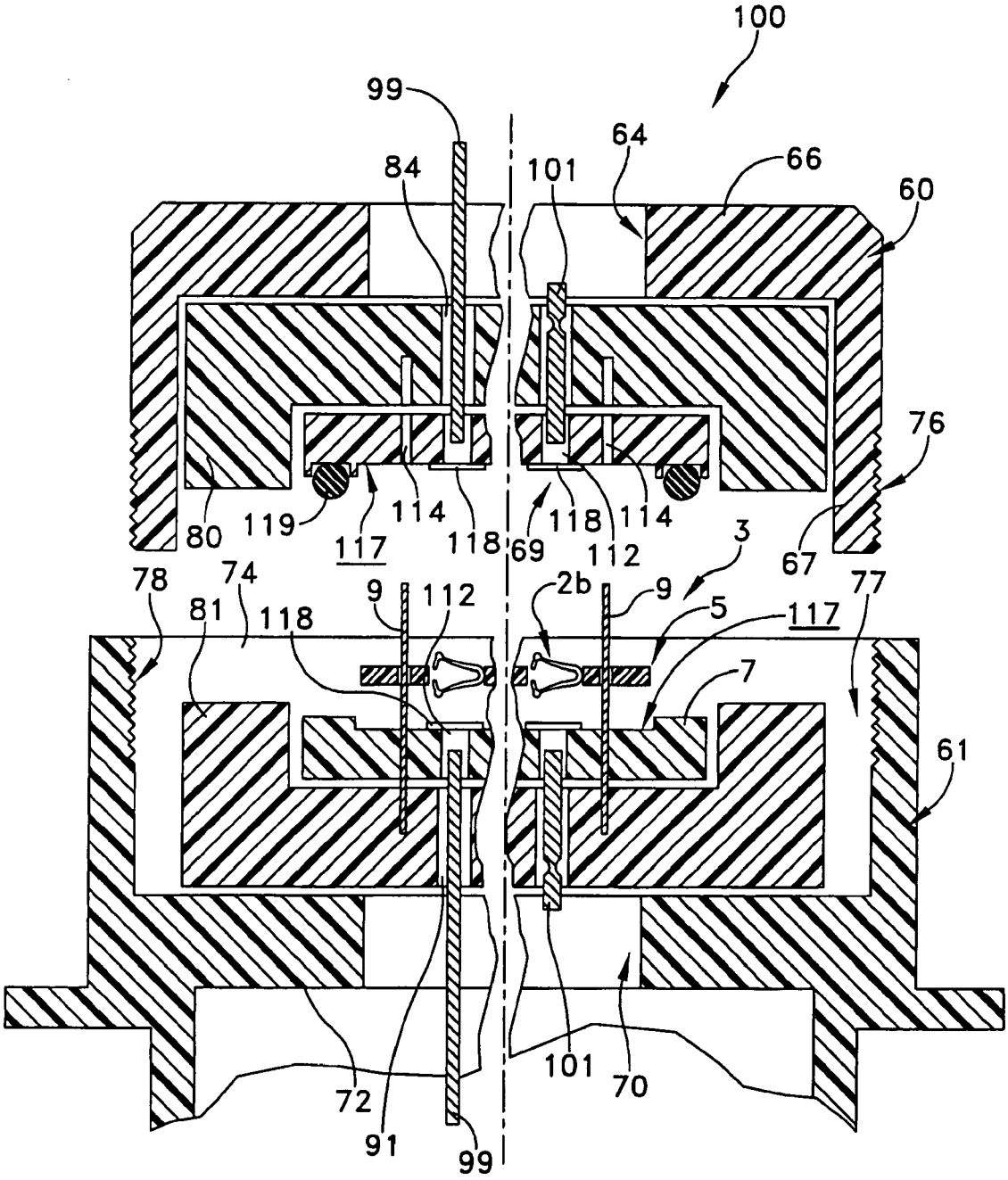
FIG. 18 is a partially cross-sectional view of a contact interposer and electrical contacts arranged in accordance with the present invention.
Figure 19:
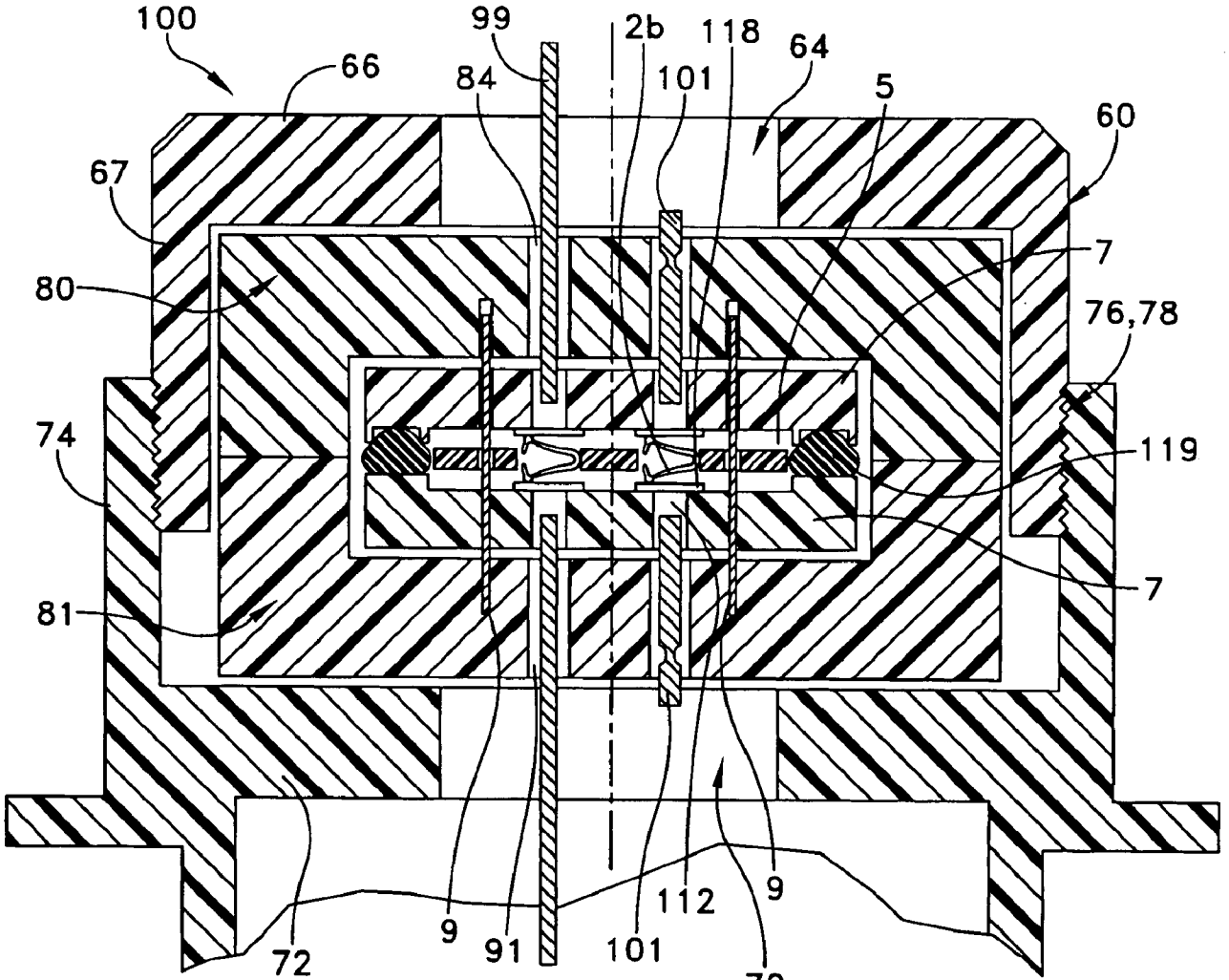
FIG. 19 is a cross-sectional view of a fully mated wire-to-wire connector shown in FIGS. 17 and 18.

Termination header 7 may be formed from a standard expoxy and fiber glass printed wiring board (PCB) material having a plurality of through-bores 112 defined through its thickness and arranged in a regular pattern or array that is complementary to the pattern of through-bores 104 in contact interposer 5 (FIGS. 17–19). One or more pilot holes 114 are also defined through portions of termination header 7 in locations that will allow for coaxial alignment with pilot holes 106 of contact interposer 5 when interposer assembly 3 is positioned within housings 60 and 61. Of course, termination headers 7 may comprise other materials, e.g., ceramics, polymers, and/or composite materials. Advantageously, through-bores 112 are plated throughout their internal length with a conductive metal, e.g., tin, gold, or the like, and closed off at an interior end. In this way, a terminal pad 118 is formed on face 117 of each terminal header 7 (FIG. 18) so as to hermetically seal through-bores 112 from the ambient environment, but provide an electrically conductive pathway to wires 99 or wire-crimp terminal contact 101. Terminal pads 118 are arranged on face 117 of each terminal header 7 in a regular pattern or array that is complementary to the pattern of through-bores 104 in contact interposer 5. An o-ring 119 may be fixedly positioned on face 117 of one of terminal headers 7 so as to be in surrounding relation to the array of terminal pads 118.

Interposer assembly 3 is mounted within a wire-to-wire connector 100 in the following manner. Guide-cradles 80, 81 are first positioned within housing 60, 61, respectively, such that wire-receiving passageways 84 of guide-cradle 80 are arranged in coaxially aligned relation with wire-receiving passageway 64 of housing 60, and wire-receiving passageways 91 of guide-cradle 81 are arranged in coaxially aligned relation with wire-receiving passageway 70 of housing 61. Once in this position, a termination header 7 is positioned on each mating face of each guide-cradle 80, 81. In this position, terminal pads 118 face outwardly. Pilot pins 9 are then fixedly positioned within pilot holes 114 of at least one of termination headers 7 (shown within housing 61 in FIGS. 17–19). It will be understood that guide-cradles 80,81 are mounted within housings 60,61 such that at least one of housings 60,61 may rotate freely about its respective guide-cradle. In this way, the positional and electrical correspondence between terminal pads 118 on each terminal header 7 will be maintained during mating of housing 60 to housing 61. With pilot pins 9 located in pilot holes 114, a contact interposer 5 or 5*a* may be positioned within the wire-to-wire connector system 100. In one embodiment. contact interposer 5 has a plurality of electrical contacts 2*a* positioned within through-openings 10 is arranged in confronting coaxial relation with termination header 7 which has pilot pins 9 positioned within pilot holes 114. Once in this position, contact interposer 5 is moved toward termination header 7 so that pilot pins 9 are received within pilot holes 106. The tips of pilot pins 9 may then be swaged or otherwise capped so as to prevent contact interposer 5 from easily sliding off pilot pins 9.

Figure 15:
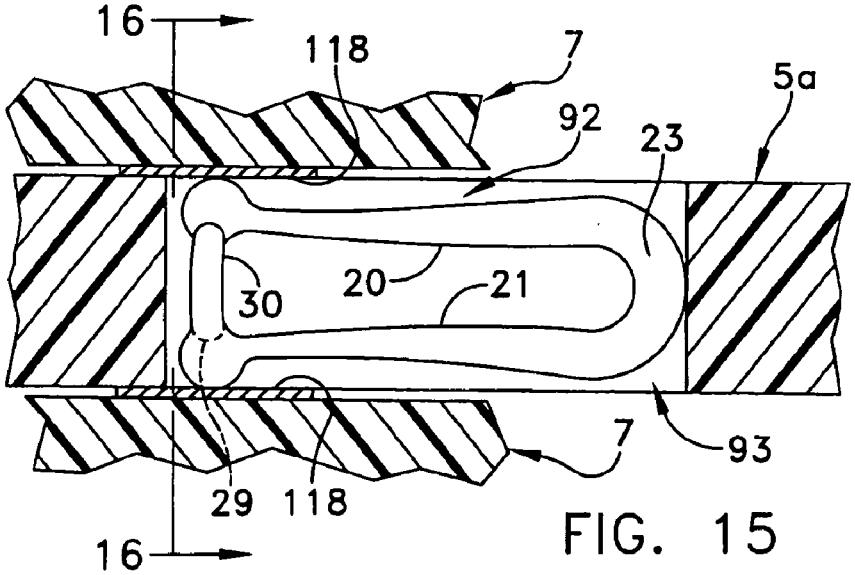
FIG. 15 is a cross-sectional view of the electrical contact and contact interposer shown in FIG. 13, in deflected condition and positioned between a pair of opposing termination headers.
Figure 16:
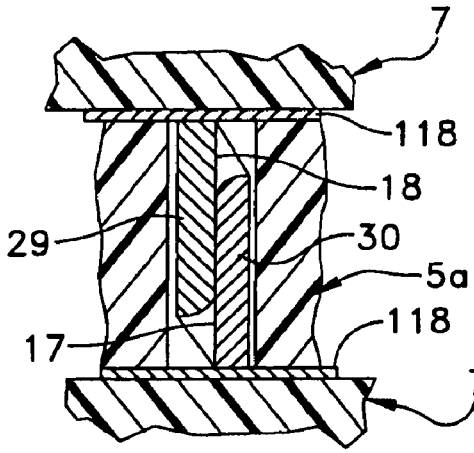
FIG. 16 is a cross-sectional view taken along line 16—16 of FIG. 15.

In another embodiment, electrical contacts 2*b* are positioned within cavities 92 of contact interposer 5*a* with first major face 17 of shorting section 29 being substantially coplanar with the second major face 18 of the shorting section 30 (FIGS. 10–13). Thus, the shorting sections are poised for mutual engagement along their respective major faces upon deflection of the contact. When contact interposer 5*a* is positioned between termination headers 7(FIG. 13) and compressed to the deflected condition shown in FIGS. 15 and 16, deflecting spring arms 20,21 are moved to a position where they are relatively closer together. In this position, shorting sections 29, 30 overlap and, as best seen in FIG. 16 first major face 17 of shorting section 29 engages second major face 18 of shorting section 30, thereby producing a short and direct electrical path between the contact noses 25, 26. The shorter electrical path has lower electrical resistance than the longer path which extends through both spring arms 20, 21. Current flow will favor the lower resistance path, of course, and the shorter path results in a reduced self-inductance effect when compared to the longer path through the spring arms. By engaging shorting sections 29, 30 along their major faces instead of their side edges, the problem of aligning and mutually engaging very thin side edges, such as those having a thickness of 0.0045 inches or less, is avoided. As electrical contact 2*b* is compressed, contact noses 25,26 exert a slight wiping action along terminal pads 118 due to changing angularity between arms 20, 21. This wiping action serves to clean terminal pads 118 by rubbing away dirt and oxides which may have accumulated.

Referring once more to FIGS. 17–19, wire conductors 99 or wire-crimp terminal contact 101 are inserted through wire-receiving passageways 64, 70, 84, and 91, respectively, so that a conductive end portion of each is positioned within a plated-through-hole 112 of each termination header 7. In this position, each wire 99 or wire-crimp terminal contact 101 is then soldered in place so as to create an electrical engagement and signal transmission pathway with the underside of a conductive pad 118 on each termination header 7.

With wires 99 or wire-crimp terminal contact 101 electrically engaged with termination headers 7, within housings 60, 61, housing 60 may be mated to housing 61 so as to complete wire-to-wire connector 100. Referring to the exemplary sequence illustrated in FIGS. 18 and 19, housing 60 is oriented so as to be in confronting coaxial relation with housing 61 such that threads 76 on the lower outer surface of annular wall 67 engage corresponding threads 78 of annular wall 74 of housing 61. Once in this position, one of housings 60, 61 is rotated relative to the other so as to cause threads 76, 78 to engage one another and thereby pull housings 60, 61 toward one another. As this occurs, conductive pads 118 on termination header 7 of housing 60 move toward engagement portions of each electrical contact, i.e., engagement surface 15 of electrical contacts 2*a* or contact noses 25, 26 of electrical contact 2*b*, that are positioned in contact interposer 5 or 5*a*. Conductive pads 118 engage the electrical contacts and thereby cause contact interposer 5 or 5*a* to slide toward housing 61 upon, and guided by pilot pins 9 so as to move the engagement portions of each electrical contact toward conductive pads 118 of termination header 7 positioned within housing 61. The engagement portions of each electrical contact thus engage conductive pads 118 of termination header 7 in housing 61 so as to complete each electrical circuit.

Figure 21:
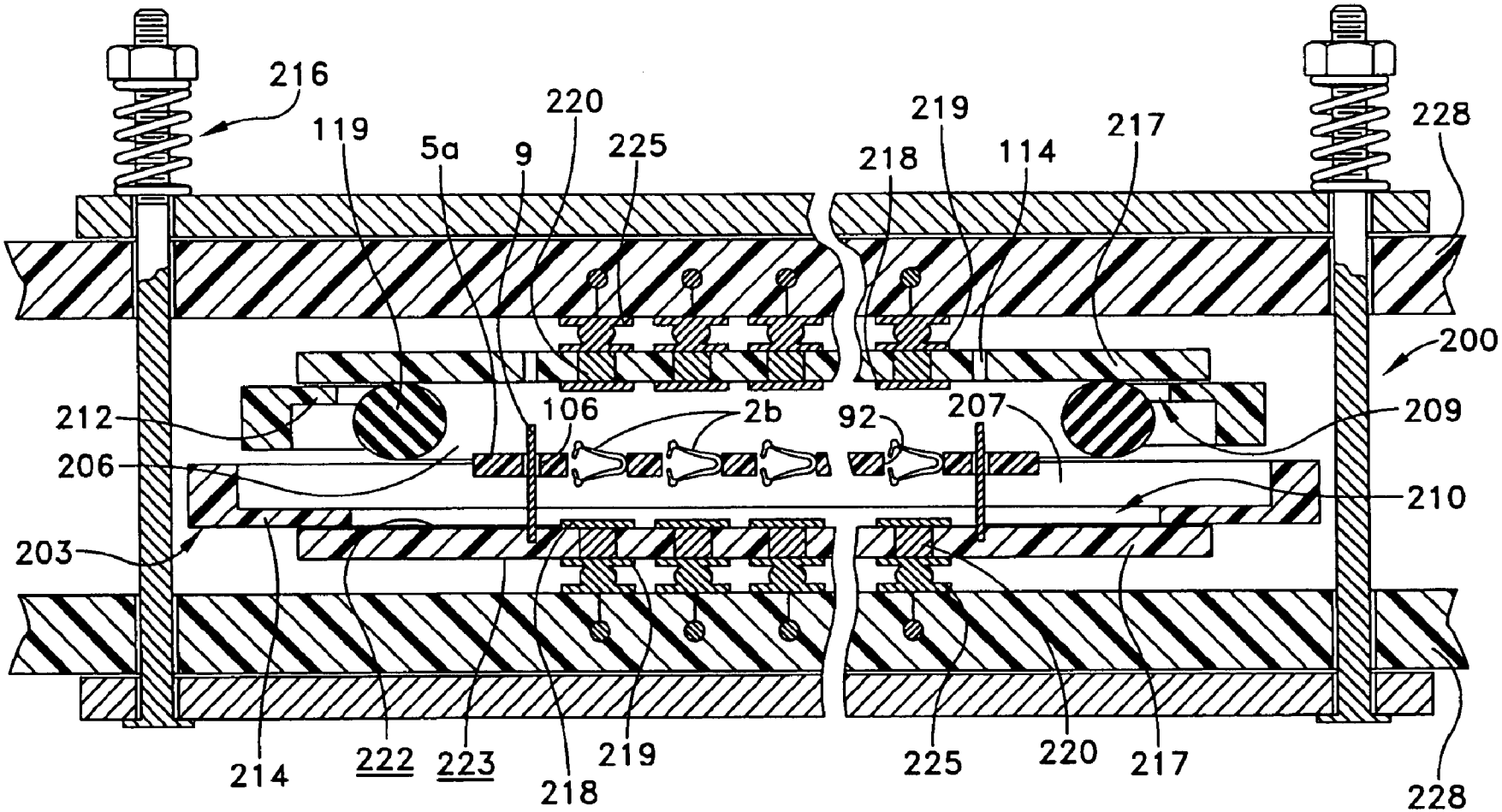
FIG. 21 is a cross-sectional view of the board-to-board connector system shown in FIG. 20.
Figure 22:
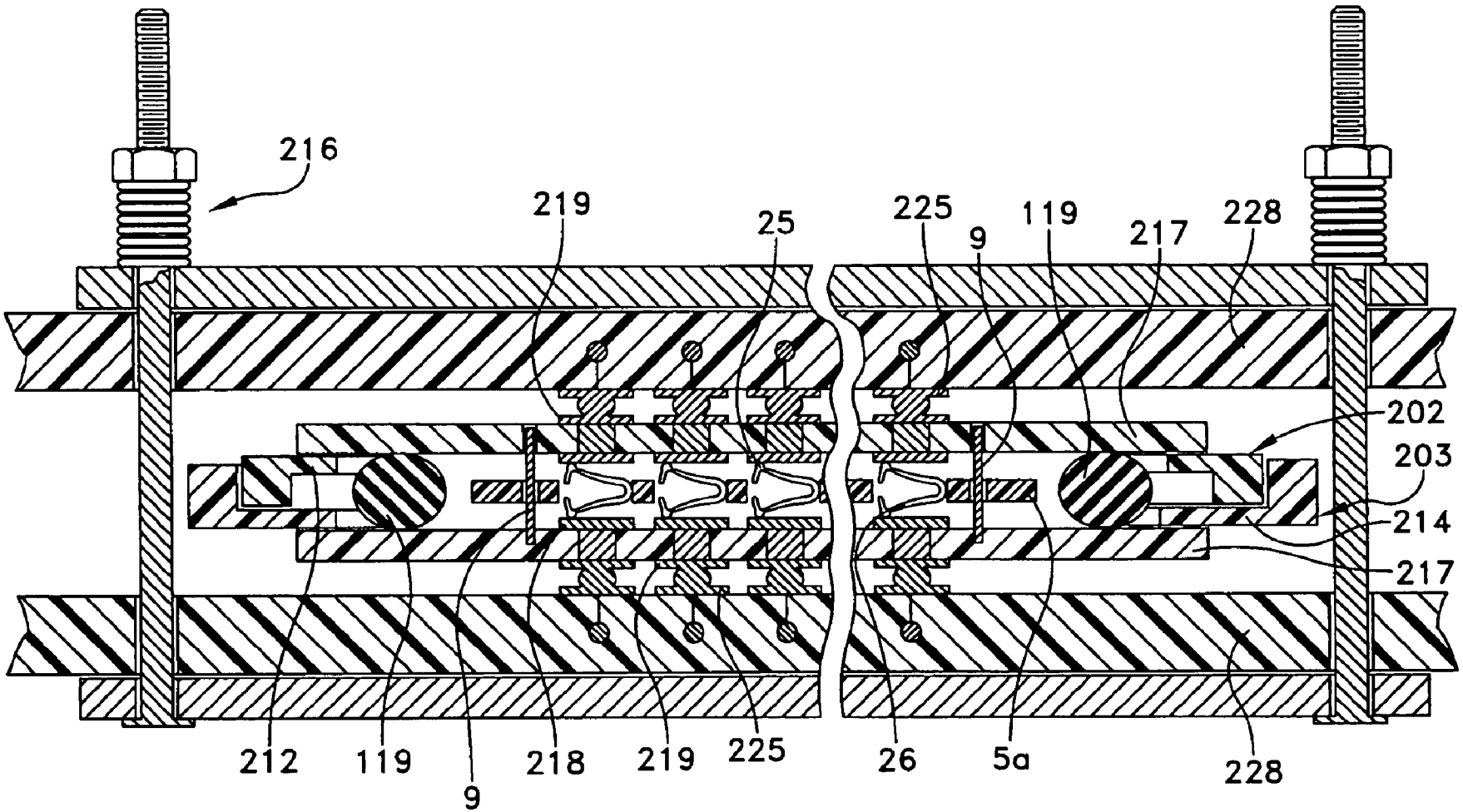
FIG. 22 is a cross-sectional view similar to that shown in FIG. 21, but illustrating a fully mated position.
Figure 23:
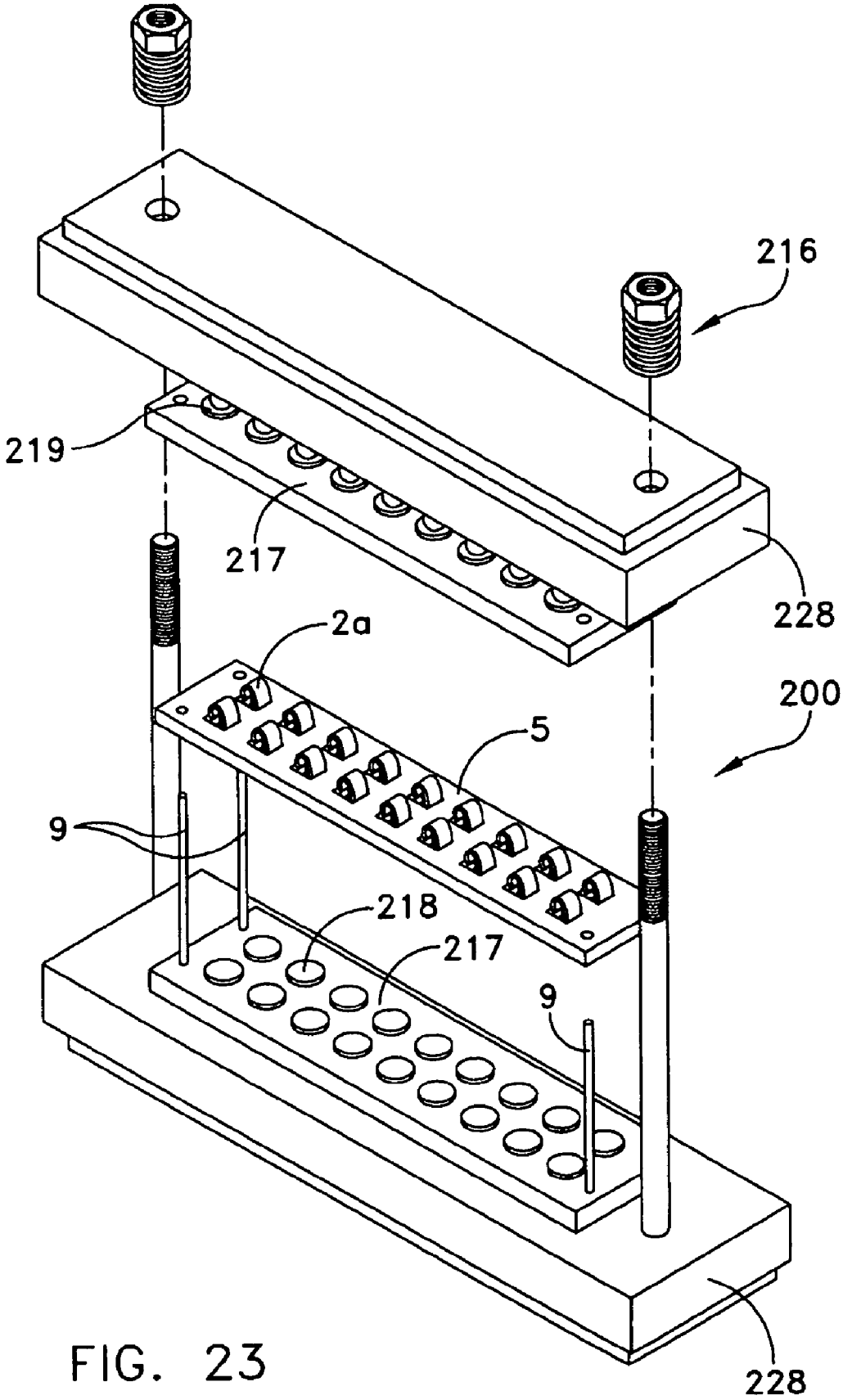
FIG. 23 is a perspective, exploded view of a board-to-board connector system similar to that shown in FIG. 20, but without connector housings.
Figure 24:
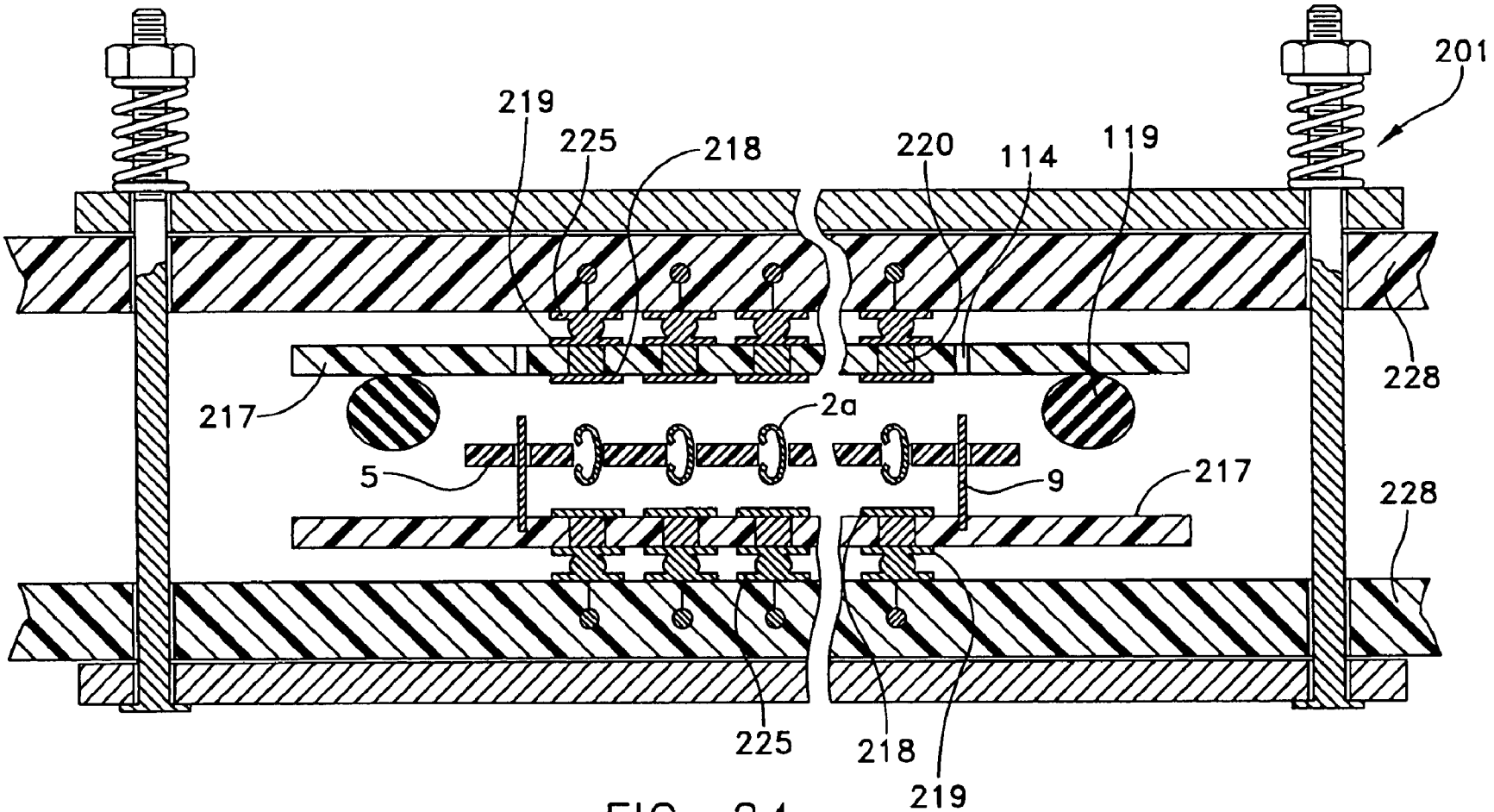
FIG. 24 is a cross-sectional view of the board-to-board connector system shown in FIG. 23.
Figure 25:
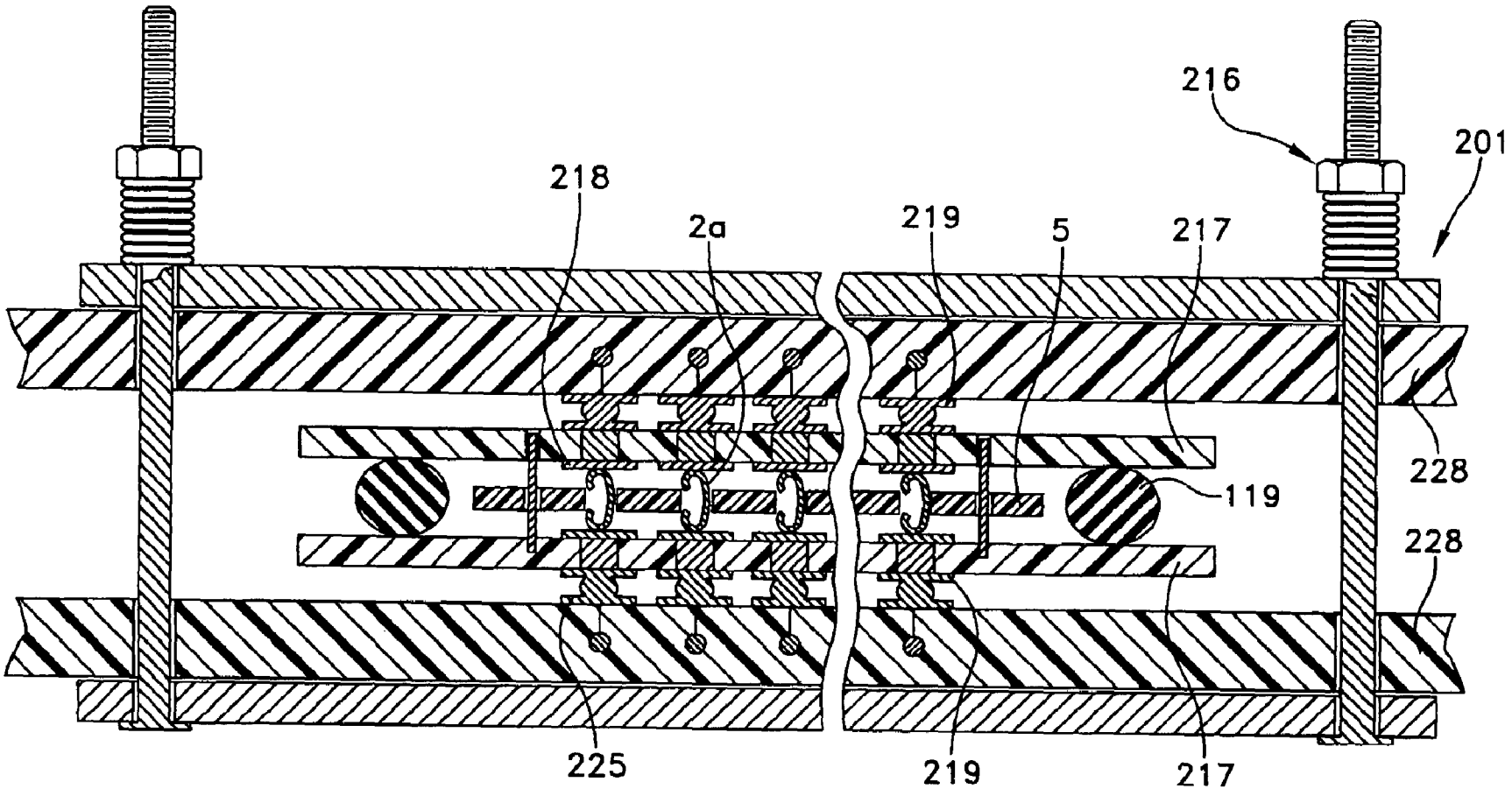
FIG. 25 is a cross-sectional view similar to that shown in FIG. 24, but illustrating a fully mated position.

Of course a wide variety of other connector systems may employ interposer assembly 3 so as to operate in accordance with the present invention. For example, a board-to-board connector system 200 may be formed having a interposer assembly 3 as follows. Referring to FIGS. 20–25, in simplified form a board-to-board connector system 200 may include a pair of mateable housings 202,203 in which interposer assembly 3 may be positioned. Of course, interposer assembly 3 may be employed for board-to-board applications without the use of housings 202,203 with adequate results (FIGS. 23–25). In an embodiment that includes housings, each will often include an annular side wall 206,207 that surrounds a centrally disposed opening 209,210, with an annular ledge 212,214 that is arranged to project into opening 209,210 from the bottom of annular side walls 206,207 (FIGS. 21–22). In the illustrated embodiment, annular side wall 206 is slightly smaller than annular side wall 207 so that housing 202 may be received within a portion of housing 203. Thus when housing 202 is mated with housing 203, the pair of housings move toward one another so as to close the distance between the confronting annular side walls 206,207 (FIG. 22). It will be understood that such board-to-board connector systems may include a wide variety of alternative structures for securely inserting and holding housing 202 in engagement with housing 203, e.g., latches, an interference fit, a threaded rod, nut and spring mounting system 216, etc.

Interposer assembly 3 includes a contact interposer 5 or 5*a*, a pair of termination headers 217, and one or more pilot pins 9, and is positioned between housings 202,203 with some portions located on housing 202 and other portions located on housing 203 and termination headers 217 (FIGS. 21 and 22). Termination headers 217 are also formed from a standard epoxy and fiber glass printed wiring board (PCB) material having a plurality of conductive vias 220 defined through their thicknesses and arranged in a regular pattern or array that is complementary to the pattern of openings 10 or cavities 92 in contact interposer 5 or 5*a*. One or more pilot holes 114 are again defined through portions of each termination header 217 in locations that will allow for coaxial alignment with pilot holes 106 when interposer assembly 3 is positioned on housings 202 and 203. Vias 220 may comprise plated-through holes that extend through the thickness of each termination header 217, and that are plated along their internal length with a conductive metal, e.g., tin, gold, or the like, and closed off at both ends. Alternatively, vias 220 may be solid or semi-solid, electrically conductive structures, e.g., slugs or posts of copper, carbon, or other electrically conductive materials. In this way, a pair of terminal pads 218, 219 are formed on both faces 222,223 of each terminal header 217 so as to provide an electrically conductive pathway to corresponding terminal pads 225 located on printed wiring board 228 (FIGS. 21–25). Of course, it will be understood that terminal pads 219 are often soldered to pad 225. An o-ring 119 may be fixedly positioned between faces 222 of terminal headers 217 so as to be in surrounding relation to the array of terminal pads 218, if sealing is required for a particular application.

Interposer assembly 3 is mounted within a board-to-board connector system 200 in much the same manner as with wire-to-wire connector system 100. More particularly, termination headers 217 are positioned such that a peripheral edge surface of each face 222 engages a respective annular ledge 212,214 of housings 202,203. In this position, terminal pads 219 face outwardly toward corresponding pads 225 on printed wiring board 228 (FIG. 21). Pilot pins 9 are then fixedly positioned within pilot holes 114 of at least one of termination headers 217 (shown within housing 203 in FIGS. 20–25). With pilot pins 9 located in pilot holes 114, a contact interposer 5 or 5*a* may be positioned within the connector system 200, e.g., a contact interposer 5*a* is illustrated in FIGS. 20–22). More particularly, a contact interposer 5*a* having a plurality of electrical contacts 2*b* positioned within through-bores the electrical contacts arranged in confronting coaxial relation with termination header 217 which has pilot pins 9 positioned within pilot holes 114. Once in this position, contact interposer 5*a* is moved toward termination header 217 so that pilot pins 9 are received within pilot holes 106. The tips of pilot pins 9 may then be swaged or otherwise capped so as to prevent the contact interposer from sliding off pilot pins 9.

Housing 202 may be mated to housing 203 so as to complete board-to-board connector system 200 in the following manner. Referring to the exemplary sequence illustrated in FIGS. 21–22, housing 202 is oriented so as to be in confronting coaxial relation with housing 203 such that termination headers 217 are facing one another with contact interposer 5*a* positioned between them. Once in this position, housings 202, 203 are moved toward one another, e.g., by actuation of nut and spring mounting system 216. As this occurs, conductive pads 218 on termination header 217 of housing 202 move toward the engagement portions of each electrical contact 2*b* that is positioned in the contact interposer 5*a*. Conductive pads 218 engage contact noses 25 of electrical contacts 2*b* and thereby cause contact interposer 5*a* to slide toward housing 203 upon, and guided by pilot pins 9 so as to move the engagement portions of each electrical contact 5*a* toward conductive pads 218 of termination header 217 positioned within housing 203. The engagement portions of each electrical contact thus engage conductive pads 218 of termination header 217 in housing 203 so as to complete each electrical circuit. As shown in FIGS. 23–25, a substantially similar inter connection system may be formed without the incorporation of housings 202, 203, with adequate results.

Figure 27:
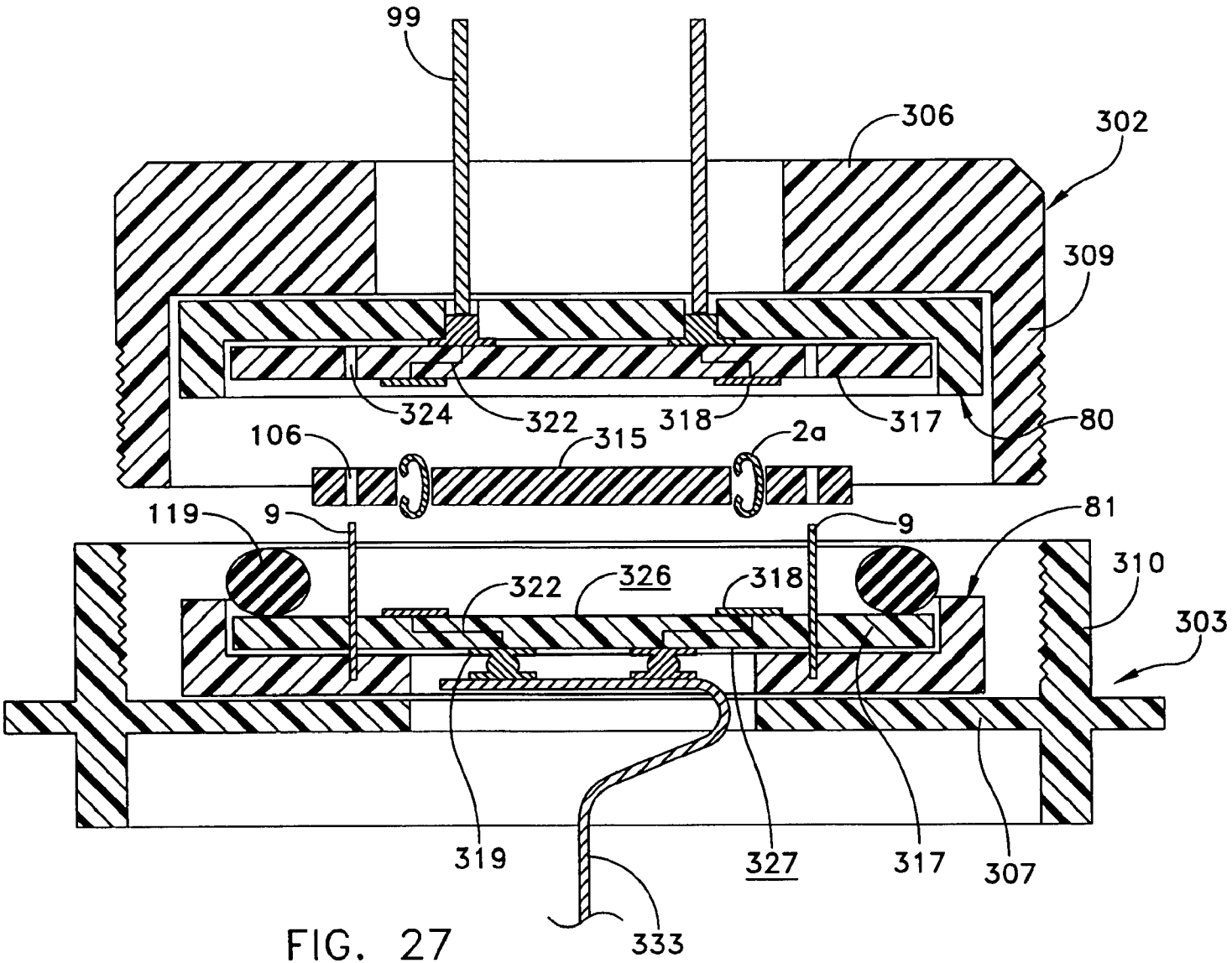
FIG. 27 is a cross-sectional exploded view of the wire-to-ribbon cable connector system shown in FIG. 26.
Figure 28:
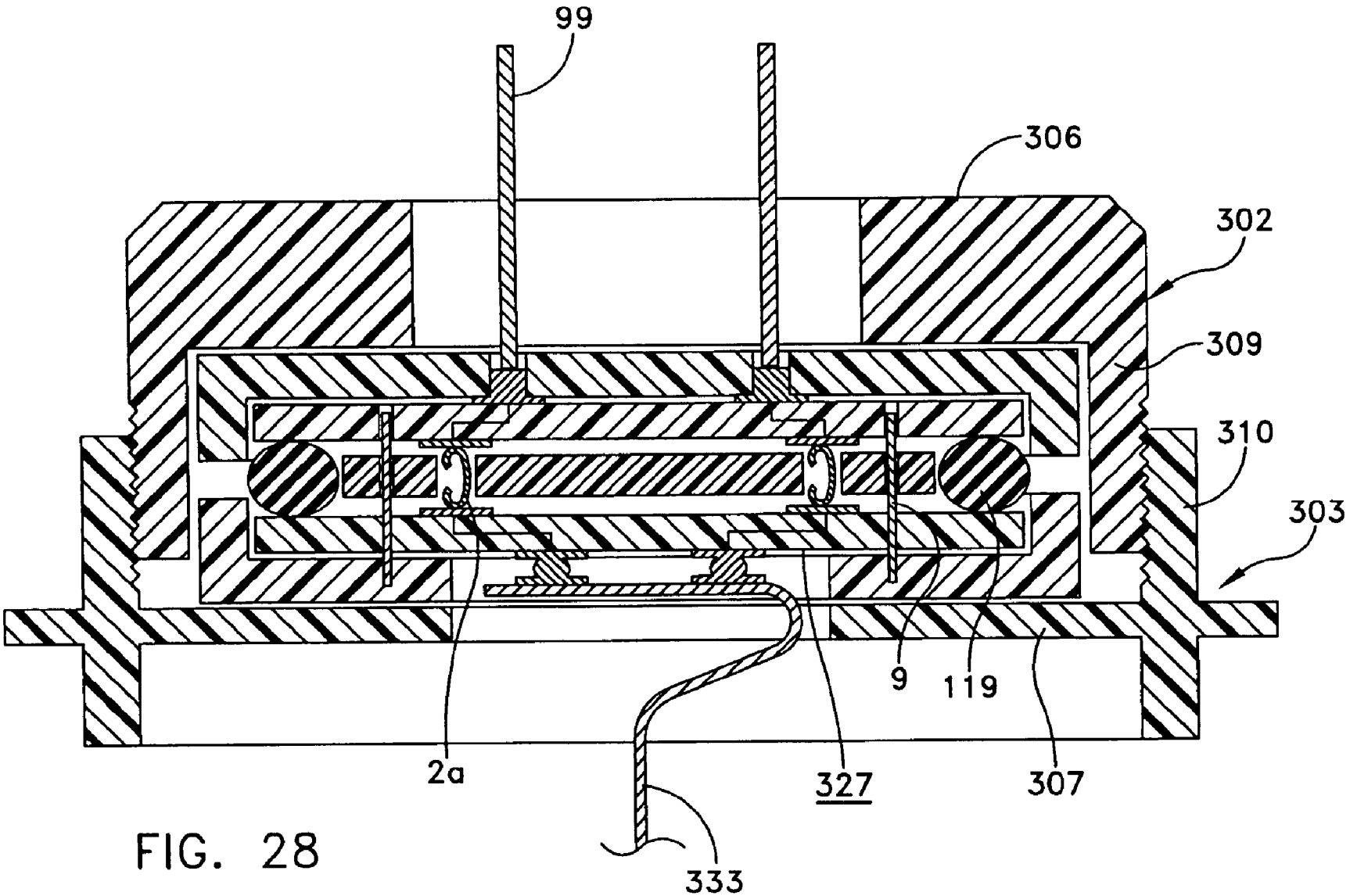
FIG. 28 is a cross-sectional view similar to that shown in FIG. 27, but illustrating a fully mated position.

In another example, a wire-to-ribbon cable connector system 300 may be formed having a interposer assembly 3 as follows. Referring to FIGS. 26–28, in simplified form a wire-to-ribbon connector system 300 includes a pair of mateable housings 302,303 in which interposer assembly 3 may be positioned. In this embodiment, each housing 302, 303 includes a base wall 306,307 that is surrounded by an annular wall 309,310. Base wall 310 defines an interior recess 314 within housing 303. In the illustrated embodiment, annular wall 309 has is slightly smaller in diameter than annular wall 310 so that housing 302 may be received within a portion of housing 303. Thus when housing 302 is mated with housing 303, the pair of housings move toward one another so as to close the distance between the confronting inner surfaces of base walls 306,307 (FIGS. 27–28). It will be understood that wire-to-ribbon connector system 300 may include a wide variety of alternative structures for securely inserting and holding housing 302 in engagement with housing 303, e.g., latches, an interference fit, a threaded rod, bayonet mount, etc.

Interposer assembly 3 includes a contact interposer 5 or 5*a*, a termination header 317, one or more pilot pins 9, and is positioned between housings 302,303 with some portions located on housing 302 and other portions located on housing 303. In this embodiment, a guide-cradle 80 is disposed in housing 302 and a guide-cradle 81 is disposed in housing 303, which guide-cradles operate as disclosed hereinabove. Termination header 317 is formed from a standard epoxy and fiber glass printed wiring board (PCB) material having a plurality of interconnects 322 (which may often be a combination of plated-through-hole and circuit trace) arranged through its thickness. One or more pilot holes 324 are defined through portions of termination header 317 in locations that will allow for coaxial alignment with pilot holes 106 when interposer assembly 3 is positioned on housings 302 and 303. In this embodiment, interconnects 322 may be plated-through-holes or solid conductive structures, e.g., tin, gold, or the like, and closed off at both ends so as to form a pair of terminal pads 318, 319 on faces 326, 327 of terminal header 317 so as to provide an electrically conductive pathway to corresponding wires 99 and ribbon cable 333 within base walls 306,307, respectively. Terminal pads 318 are arranged on face 326 of terminal header 317 in a regular pattern or array that is complementary to the pattern of electrical contacts 2*a* or 2*b* in contact interposer 5 or 5*a*. An o-ring 119 or equivalent may be fixedly positioned adjacent to face 326 of a terminal header 317 so as to be in surrounding relation to the array of terminal pads 318.

Interposer assembly 3 is mounted within a wire-to-ribbon connector system 300 in much the same manner as with wire-to-wire connector system 100 and board-to-board connector system 200. More particularly, termination headers 317 are positioned on base wall 306 of housing 302. A pair of guide-cradles 80,81 are often located within housings 302,303 on the interior surface of base walls 306,307, respectively, and as previously described hereinabove. Pilot pins 9 are then fixedly positioned within pilot holes 324 of termination header 317 (shown within housing 302 in FIG. 27). With pilot pins 9 located in pilot holes 324, and a contact interposer 5 or 5*a* may be positioned within the connector system. More particularly, contact interposer 5 or 5*a* having a plurality of electrical contacts 2*a* or 2*b* is arranged in confronting coaxial relation with housing 303 which has pilot pins 9 positioned within pilot holes 324. Once in this position, contact interposer 5 or 5*a* is moved toward housing 303 so that pilot pins 9 are received within pilot holes 106. The tips of pilot pins 9 may then be swaged or otherwise capped so as to prevent contact interposer 5 or 5*a* from sliding off pilot pins 9.

Housing 302 may be mated to housing 303 so as to complete wire-to-ribbon connector system 300. Referring to FIG. 28, housing 302 is oriented so as to be in confronting coaxial relation with housing 303 such that base walls 306,307 are facing one another with contact interposer 5 positioned between them. Once in this position, housings 302, 303 are moved toward one another so that housing 302 engages housing 302. As this occurs, conductive pads 318 on termination headers 317 of housing 302, 303 move toward one another. Conductive pads 318 engage electrical contacts 2*a* or 2*b* and thereby cause contact interposer 5 or 5*a* to slide toward housing 303 upon, and guided by pilot pins 9 so as to move the engagement portions of each electrical contacts 2*a* or 2*b* toward conductive pads 318 positioned within housing 303. The engagement portions of each of electrical contacts 2*a* or 2*b* thus engage conductive pads 318 in housing 303 so as to complete each electrical circuit.

It is to be understood that the present invention is by no means limited only to the particular constructions herein disclosed and shown in the drawings, but also comprises any modifications or equivalents within the scope of the claims.

What is claimed is:

1. A connector system comprising:

a first header including at least one conductive pad that is electrically engaged with a conductor;

a second header including at least one conductive pad that is electrically engaged with a conductor and is positioned in confronting relation with said at least one conductive pad of said first header, wherein each of said first and second headers includes a first face comprising at least one opening leading into at least one blind hole and a second face on which is located said at least one conductive pad, and further wherein each of said at least one blind holes is defined by a surface within each of said headers including a layer of conductive metal and said at least one conductive pad is in electrical communication with said layer of conductive metal; and an interposer located between said first header and said second header, with at least one contact that extends continuously through said interposer so as to have a portion projecting outwardly toward said at least one conductive pad of said first header and another portion projecting outwardly toward said at least one conductive pad of said second header, wherein said interposer is movable between (i) a first position wherein said portions of said at least one contact are spaced away from said conductive pads, and (ii) a second position wherein said portions of said at least one contact electrically engage said conductive pads.

2. A connector system according to claim 1 wherein said first and second housings include a conductor receiving passageway extending through a base wall and surrounded by an annular wall that together define an interior recess into which wire-receiving passageway opens.

3. A connector system according to claim 1 wherein each of said first and second headers includes a first face comprising a plurality of openings each leading into a blind hole and a second face on which is located a plurality of conductive pads.

4. A connector system according to claim 3 wherein each of said plurality of blind holes is defined by a surface within said header including a layer of conductive metal, and further wherein one of each of said plurality of conductive pads is in electrical communication with said layer of conductive metal in one of said plurality of blind holes.

5. A connector system according to claim 4 wherein each of said plurality of conductive pads hermetically seals said blind bore from the ambient environment, and provides an electrically conductive pathway.

6. A connector system according to claim 1 comprising an o-ring fixedly positioned on a face of one of said first and second headers so as to be in surrounding relation to said at least one conductive pad.

7. A connector system according to claim 4 comprising an o-ring fixedly positioned on a face of one of said first and second headers so as to be in surrounding relation to said plurality of conductive pads.

8. A connector system according to claim 1 wherein said interposer includes at least one through-bore in which said contact is positioned so as to be located between said at least one conductive pad located on said first and said at least one conductive pad located on second headers.

9. A connector system according to claim 1 comprising at least one pilot pin projecting outwardly from at least one of said first and second headers.

10. A connector system according to claim 9 wherein said interposer includes at least one pilot hole positioned so that each slidingly receives and guides one of said at least one pilot pin.

11. A connector system according to claim 1 comprising three pilot pins projecting outwardly from at least one of said first and second headers.

12. A connector system according to claim 11 wherein said interposer includes three pilot holes positioned so that each slidingly receives and guides one of said three pilot pins.

13. A connector system according to claim 1 wherein said interposer includes at least two contacts that are lodged within through-bores and fixed in place such that a first engagement portion of each of said contacts projects outwardly from a first side surface of said interposer and a second engagement portion of each of said contacts projects outwardly from a second side surface of said interposer.

14. A connector system according to claim 1 further comprising a guide-cradle located on an interior surface of at least one of said first and second housings, said guide-cradle defining a wire-receiving passageway extending through a mating face that is surrounded by an annular wall which together define an interior recess into which said wire-receiving passageway opens.

15. A connector system according to claim 14 wherein said guide-cradle provides support and organization for conductors entering said first and second housing.

16. A connector system according to claim 15 wherein at least one of said first header and said second header is positioned within said interior recess of said at least one guide-cradle, wherein each of said first and second headers includes a first face comprising a plurality of openings each (i) leading into a blind hole and, (ii) confronting said wire-receiving passageway, and a second face on which is located a plurality of conductive pads.

17. A connector system according to claim 16 wherein each of said plurality of blind holes is defined by a surface within said header including a layer of conductive metal, and further wherein one of each of said plurality of conductive pads is in electrical communication with said layer of conductive metal in one of said plurality of blind holes.

* * * * *